US009296515B2

(12) United States Patent
Banik

(10) Patent No.: US 9,296,515 B2
(45) Date of Patent: Mar. 29, 2016

(54) TOP CAP

(75) Inventor: Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 677 days.

(21) Appl. No.: 12/039,293

(22) Filed: Feb. 28, 2008

(65) Prior Publication Data

US 2009/0218244 A1 Sep. 3, 2009

(51) Int. Cl.
*B65D 19/22* (2006.01)
*B65D 19/38* (2006.01)

(52) U.S. Cl.
CPC ..... *B65D 19/38* (2013.01); *B65D 2519/00338* (2013.01); *B65D 2571/00055* (2013.01)

(58) Field of Classification Search
USPC ..... 108/51.11, 901, 53.1, 53.5, 53.3; 206/821, 386, 599, 508, 509, 511, 512; 248/346.02
See application file for complete search history.

(56) References Cited

U.S. PATENT DOCUMENTS

| | | | | |
|---|---|---|---|---|
| D35,174 | S | 10/1901 | Conklin | |
| 4,000,704 | A | 1/1977 | Griffin, Jr. | |
| 4,413,737 | A | 11/1983 | Wind | |
| 4,480,748 | A * | 11/1984 | Wind | 206/386 |
| D288,978 | S | 3/1987 | Wind | |
| 5,080,023 | A * | 1/1992 | Miura et al. | 108/55.3 |
| D356,200 | S | 3/1995 | Kern et al. | |
| 5,547,081 | A * | 8/1996 | Mullock et al. | 206/504 |
| D404,180 | S | 1/1999 | Apps et al. | |
| D429,052 | S | 8/2000 | Ito et al. | |
| D434,509 | S | 11/2000 | Oliver et al. | |
| 6,209,464 | B1 | 4/2001 | Elder | |
| D445,554 | S | 7/2001 | Blason et al. | |
| D446,900 | S | 8/2001 | Koefelda et al. | |
| D459,049 | S | 6/2002 | Apps et al. | |
| D459,050 | S | 6/2002 | Meyer | |
| D464,186 | S | 10/2002 | Medoff et al. | |
| 6,718,887 | B1 * | 4/2004 | Cook, Sr. | 108/53.3 |
| D489,860 | S | 5/2004 | Apps et al. | |
| 6,910,668 | B2 * | 6/2005 | Henning | 248/346.02 |
| D508,300 | S | 8/2005 | O'Dell et al. | |
| D544,675 | S | 6/2007 | Ishikawa et al. | |
| D548,924 | S | 8/2007 | Frankenberg | |
| D550,925 | S | 9/2007 | Boaler et al. | |

* cited by examiner

*Primary Examiner* — Daniel Rohrhoff
(74) *Attorney, Agent, or Firm* — Nixon Peabody LLP

(57) ABSTRACT

A top cap designed to allow any of a pallet, a bulk bin and a metal rack, each having a different support configuration, or any of a nestable pallet and a bulk bin, to stack securely on an upper surface of the top cap. The top cap including a plurality of raised and/or indented portions on the upper surface configured to mate with a bottom surface of the pallet, bulk bin or metal rack. The top cap also being configured to allow other pallets, bulk bins, or metal racks to stack securely on the upper surface of the top cap. The top cap being formed from a molded plastic material.

15 Claims, 30 Drawing Sheets

TOP CAP

CROSS-REFERENCE TO RELATED APPLICATIONS

The application for the present invention is being filed concurrently with U.S. Design patent application Ser. No. 29/304,294.

FEDERALLY SPONSORED RESEARCH OR DEVELOPMENT

Not Applicable.

TECHNICAL FIELD

The invention relates to a top cap having an upper surface configured to securely mate with the footprint of all of one or more pallet designs, one or more bulk bin designs and one or more metal rack designs; or all of one or more nestable pallet designs with one or more bulk bin designs and/or one more metal rack designs.

BACKGROUND OF THE INVENTION

Goods and other items are transported utilizing a variety of containers and other packaging or transportation systems. Such packaging or transportation systems can include pallets, bulk bins, metal racks, etc. In some instances, a top cap is utilized as part of one or more of these systems. The top cap allows for securing a second load of product on top of a lower load through either a pallet, bulk bin or rack. The top cap also protects the top (or top of the top row) of the goods during shipping.

In some cases, it may be necessary to stack one packaging system carrying goods or other items onto another. This may be done to make the most efficient use of the cargo hold of a ship, intermodal or truck.

In situations where packaging systems are stacked on top of one another, it is necessary to insure that the system on top is securely positioned on the lower system. Otherwise, the upper system could become unstable and possibly injure someone below and/or damage the goods or other items being shipped.

Each type of packaging system has its own bottom or lower structure which defines a footprint or support configuration. Moreover, different configurations can be found within a particular footprint. For example, there can be several styles of bulk bins or pallets in the same footprint, each having its own configuration.

One class of a packaging system—plastic pallets—are typically categorized as either stackable or nestable. As used herein, a stackable pallet includes one or more stringer which define a flat bottom surface (stringers may vary in configuration). The bottom surface of a stackable pallet rests on the deck of a pallet below it when stacked. In contrast, as used herein, a nestable pallet includes a plurality of legs. When stacked on a like pallet, the legs will descend into the leg pockets of the pallet below resulting in a greater nest ratio than stackable pallets.

Known top caps have been designed to mate with nestable pallets, to enable the nestable pallet to be securely positioned on the top cap. However, such top caps would not work with other systems. Similarly, some top caps have been separately designed to mate with only bulk bins, or only the combination of bulk bins and stackable pallets having a similar footprint.

While theses systems are useful, it is desirable to be able to stack different types or combinations of systems utilizing the same top cap. This ability would facilitate stacking of various forms of packaging without requiring a selection of the correct top cap.

The present invention is provided to solve the problems discussed and to provide advantages and aspects not provided by prior top caps of this type. A full discussion of the features and advantages of the present invention is deferred to the following detailed description, which proceeds with reference to the accompanying drawings.

SUMMARY OF THE INVENTION

The present invention provides a top cap designed to allow a variety of different packaging systems to be securely stacked onto the top surface of the top cap. The systems can include one or more different pallet designs, one or more different bulk bin designs, and one or more different metal rack designs. Moreover, the top cap is also configured to nest with other top caps of the same type, as well as certain top caps having a different design.

The top cap has a generally rectangular or square shape, and is formed in a sheet having a variety of structure on both an upper or top surface and a lower or bottom surface. Specifically, the upper surface is contoured to capture or mate with the bottom surface or footprint of the various pallets, bulk bins and metal racks. The lower surface preferably includes a plurality of ribs extending downwardly from a planar portion. The ribs provide stiffness and support without significantly increasing the weight of the top cap.

In accordance with one aspect of the invention, the top cap is specifically configured to include an upper surface designed to mate with the bottom surface or structure (i.e., footprint) of each of one or more pallet designs, one or more bulk bin designs and one or more metal rack designs. In other words, a pallet or a bulk bin or a metal rack could be stacked on the top cap as desired. The bottom surface for each design forms a footprint that matches with corresponding structure on the top surface of the top cap. The structure on the top surface of the top cap will appear as raised and/or indented portions, such as ridges and other similar structures. In some instances, a portion of the structure on the top surface used to mate with the footprint of one system (e.g., a first pallet design) may also be used with other structure on the top surface to mate with the footprint of another system (e.g., a first bulk bin design or a first metal rack design). The designs within a particular group of systems (e.g., pallets) can be similar or have differences.

In accordance with another aspect of the invention, a top cap is provided comprising a generally rectangular sheet having a lower surface and an upper surface. The upper surface is contoured to securely mate with the bottom surface of a first nestable pallet, the bottom surface of a first bulk bin, and the bottom surface of a metal rack.

The contour of the upper surface can also be configured to mate with other pallet or bulk bin designs having different bottom surfaces or footprints than the first pallet and first bulk bin. Additionally, the upper surface can be contoured to securely mate with the bottom surface of a first metal rack, as well as other metal racks.

In accordance with yet another aspect of the invention, a top cap is provided that comprises a first upper surface configured to securely mate with any of a footprint of a first pallet design, a footprint of a first bulk bin design, and a footprint of a first metal rack design. That is, the top cap allows for any of these systems to be securely stacked on the top cap.

The top cap also includes a second surface opposing the first surface for contacting one or more items being transported. The second surface can include a plurality of ribs projecting away from the second surface.

In addition to being configured to securely mate with a first pallet, bulk bin and metal rack, the first surface of the top cap can be further configured to mate with one or more of a footprint of a second pallet design different than the footprint of the first pallet design, a footprint of a second bulk bin design different than the footprint of the first bulk bin design, or a footprint of a second metal rack design different than the footprint of the first metal rack design.

The top cap can include a set of raised portions on the first surface positioned to mate with the bottom surface or structure defining the footprint of the first pallet. Similarly, the top cap can include a set of raised portions on the first surface positioned to mate with the bottom surface or structure defining the footprint of the first bulk bin, and a set of raised portions on the first surface positioned to mate with the bottom surface or structure defining the footprint of the first metal rack.

The top cap can be formed from a plastic or other similar or suitable material. For example, the top cap could be an injection molded plastic, or a structural foam. The top cap can be formed under high pressure or as a thermoform.

The top caps disclosed herein can be configured to nest with one of another same model top cap or a different model top cap.

In accordance with another aspect of the invention, a plastic top cap is provided for use in transporting goods which is configured for facilitating stacking of other transportation components. The top cap comprises an upper surface having a generally rectangular shape. The upper surface includes a first plurality of raised portions configured to securely capture the bottom surface or structure of a first pallet having a first pallet footprint design, a second plurality of raised portions configured to securely capture the bottom surface or structure of a first bulk bin having a first bulk bin footprint design; and a third plurality of raised portions configured to securely capture the bottom surface or structure of a first metal rack having a first metal rack footprint design.

Additionally, the top cap can further comprise a plurality of raised portions configured to capture the bottom surface or structure of a second pallet having a second pallet footprint design different than the first pallet footprint design. Similarly, the top cap can include a plurality of raised portions configured to capture the bottom surface or structure of a second bulk bin having a second bulk bin footprint design different than the first bulk bin footprint design or a plurality of raised portions configured to capture the bottom surface or structure of a second metal rack having a second metal rack footprint design different than the first metal rack footprint design.

The plastic top cap further comprises a second side for contacting items being transported. The second side can include a plurality of downwardly extending ribs.

The top cap can be configured to securely stack with another top cap. The other top cap can be of the same type or in some instances, a different model top cap.

In accordance with yet another aspect of the invention, a top cap is provided which comprises a top surface having raised portions configured to securely mate with a plurality of different pallet designs; a plurality of different bulk bin designs and a plurality of different metal rack designs.

Other features and advantages of the invention will be apparent from the following specification taken in conjunction with the following drawings.

BRIEF DESCRIPTION OF THE DRAWINGS AND ATTACHMENTS

To understand the present invention, it will now be described by way of example, with reference to the accompanying drawings in which.

Figure 28:
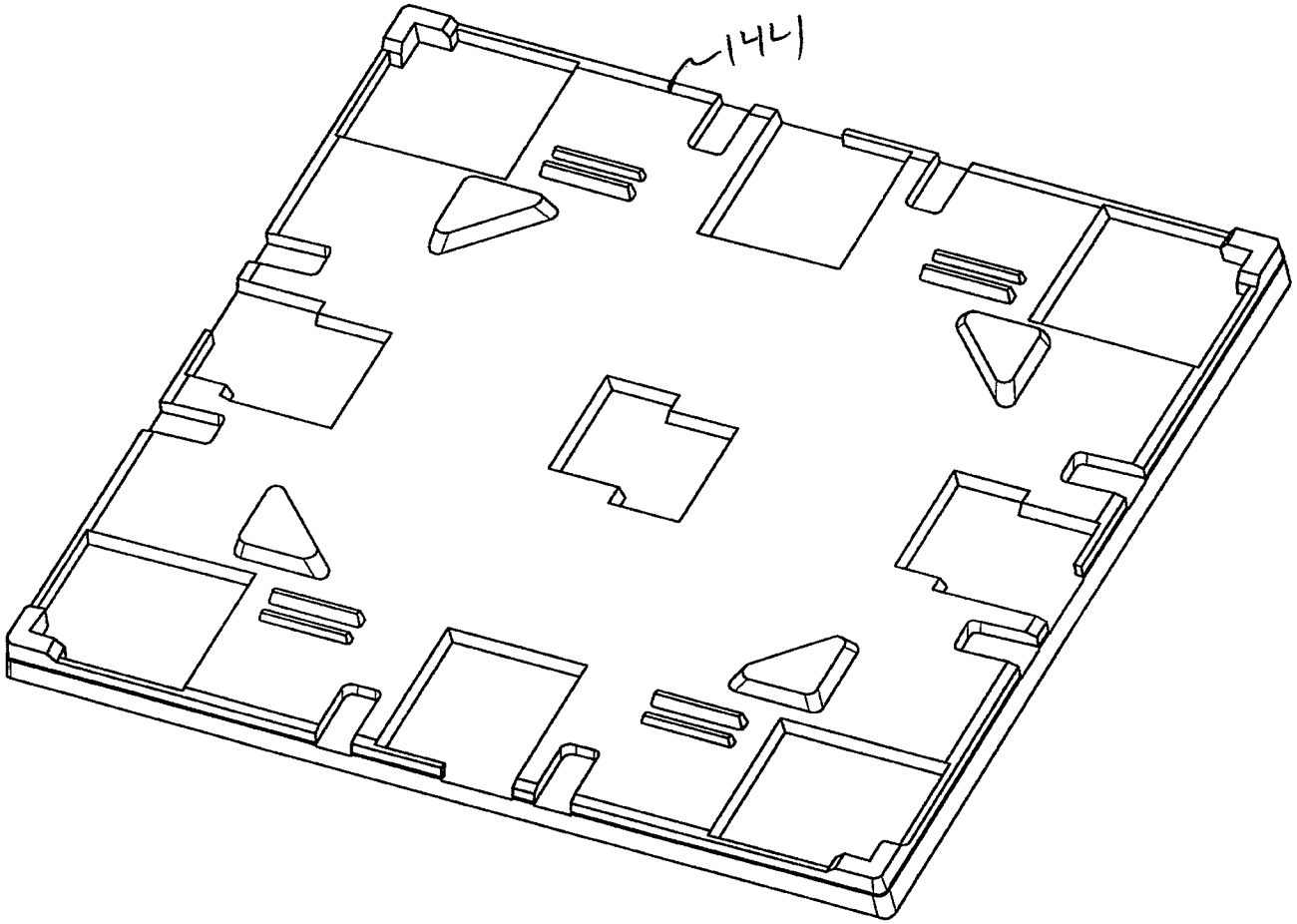
Figure 29A:
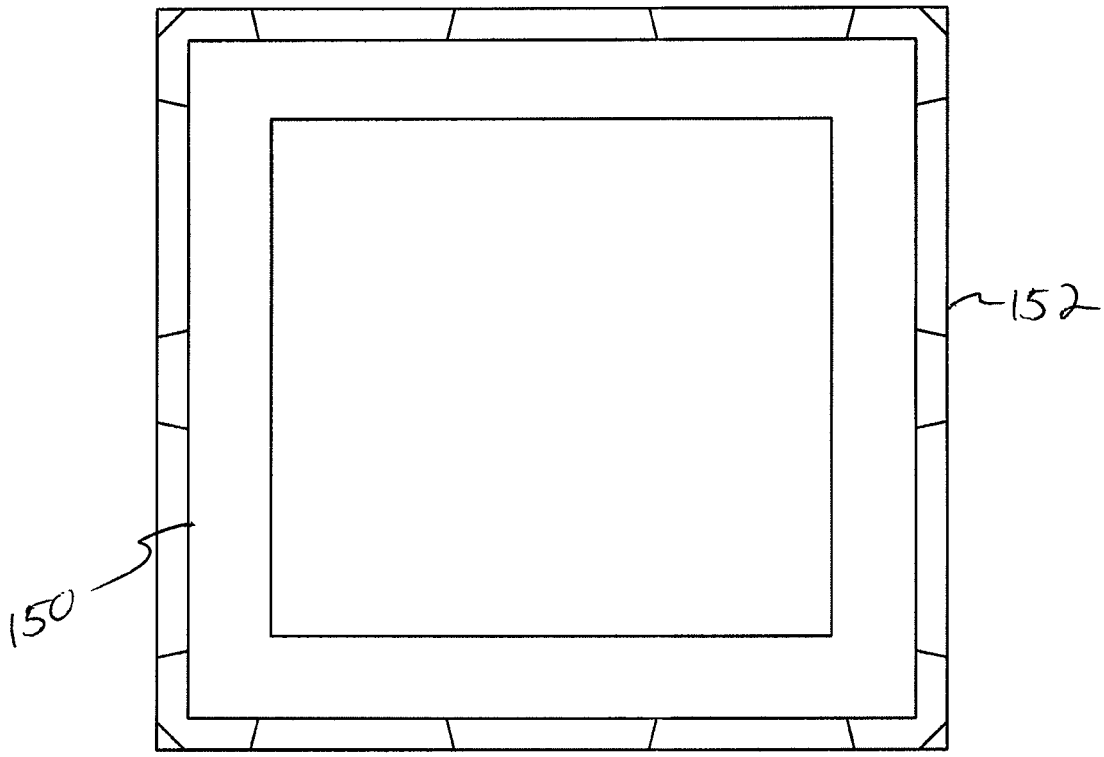
Figure 29B:
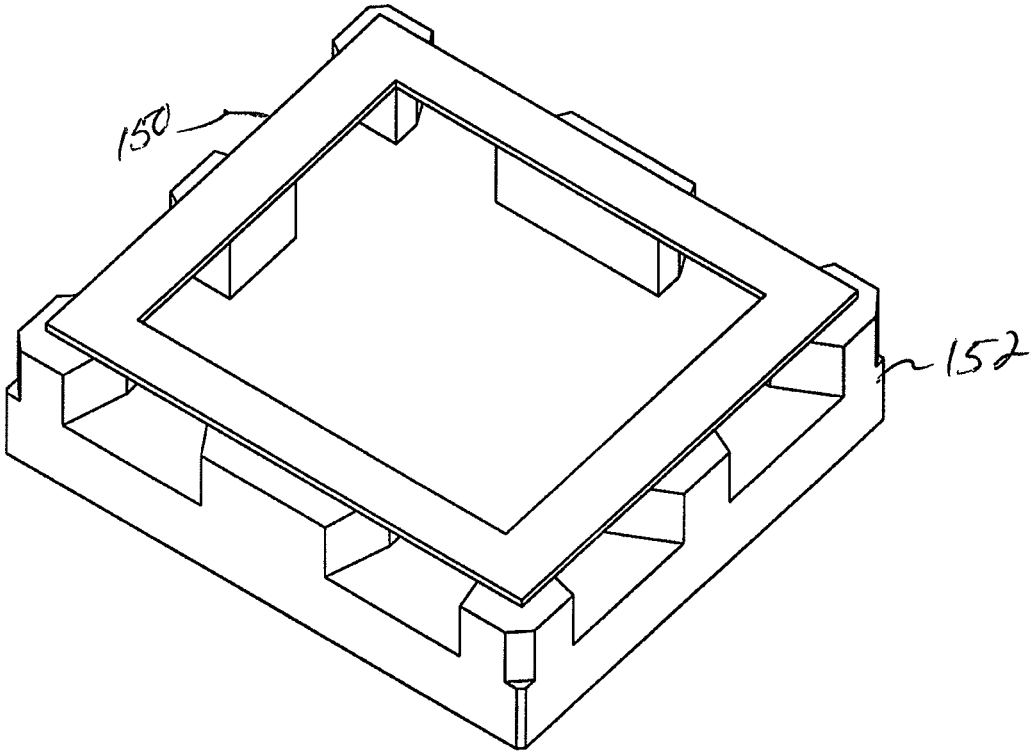

FIG. 28 a perspective view of another embodiment of a top cap having an upper surface configured to stack with other systems in accordance with the present invention; and, FIGS. 29A and 29B are a bottom plan view and a perspective view, respectively, of the bottom surface or structure of a fifth bulk bin design that can be stacked on the top caps of the present invention.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figures 1, 2:
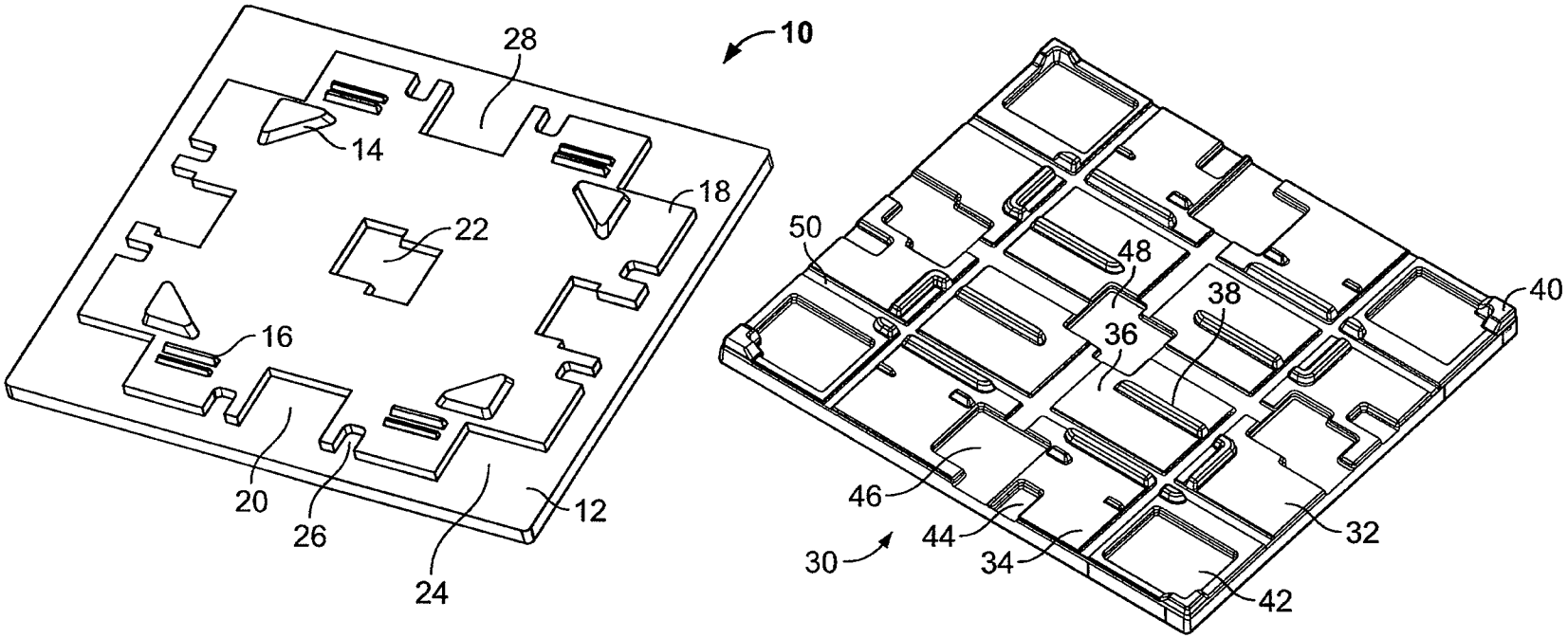
FIG. 1 is a perspective view of an embodiment of a top cap having an upper surface configured to stack with other systems in accordance with the present invention.
FIG. 2 is a perspective view of another embodiment of a top cap having an upper surface configured to stack with other systems in accordance with the present invention.

Referring to FIG. 1, a first top cap design 10 in accordance with the present invention is provided. The top cap 10 has a generally rectangular or square outline or shape (preferably dimensioned as 45×48 inches) and includes a top surface 12. The top cap 10 is preferably formed from a molded plastic.

The top surface 12 of the top cap 10 includes structure to mate with or securely support a variety of packaging systems that may be stacked on top of the top cap 10. In this embodiment, the top surface 12 includes a plurality of raised portions 14, 16, 18, which cooperate with (and in effect create) indented portions 20, 22. Certain of the raised portions 14, 16 extend upward from the raised portion 18. Indented portion 20 extends along the periphery of the top surface 12 and includes a variety of shaped regions or pockets 24, 26, 28 that extend into the raised portion 18.

A second embodiment of a top cap 30 in accordance with the present invention is shown in FIG. 2. Although having a different pattern, the top cap 30 (similar to the embodiment of FIG. 1), also includes a top surface 32 having a plurality of raised portions 34, 36, 38, 40, and indented portions 42, 44, 46, 48, 50.

In both embodiments, the topography of the top surfaces 12, 32 of the top caps 10, 30 is designed to securely mate with the footprints (i.e., of the bottom surface or structure) of one or more pallet designs, one or more bulk bin designs, and one or more metal rack designs. Accordingly, the top caps 10, 30 allow any of these designs to be securely stacked on the top surfaces 12, 32.

Both top caps 10, 30 shown in FIGS. 1 and 2, are configured to allow the same series of pallets, bulk bins and metal racks to be stacked on the top caps 10, 30. Additionally, each top cap 10, 30 is designed to stack with other top caps having the same configuration, and in some instances, with top caps of different design (such as an earlier model).

The top caps 10, 30 are preferably designed to allow the following pallets to securely stack onto the top surfaces 12, 32: ORBIS® 45×48-A CISF; ORBIS® 45×48-B CISF; ORBIS® 45×48-C CISF; ORBIS® 45×48-2 CISS; ORBIS® Powerlite™; ORBIS® AutoPal™; Schaefer Krypto-Lite®.

Figure 3A:
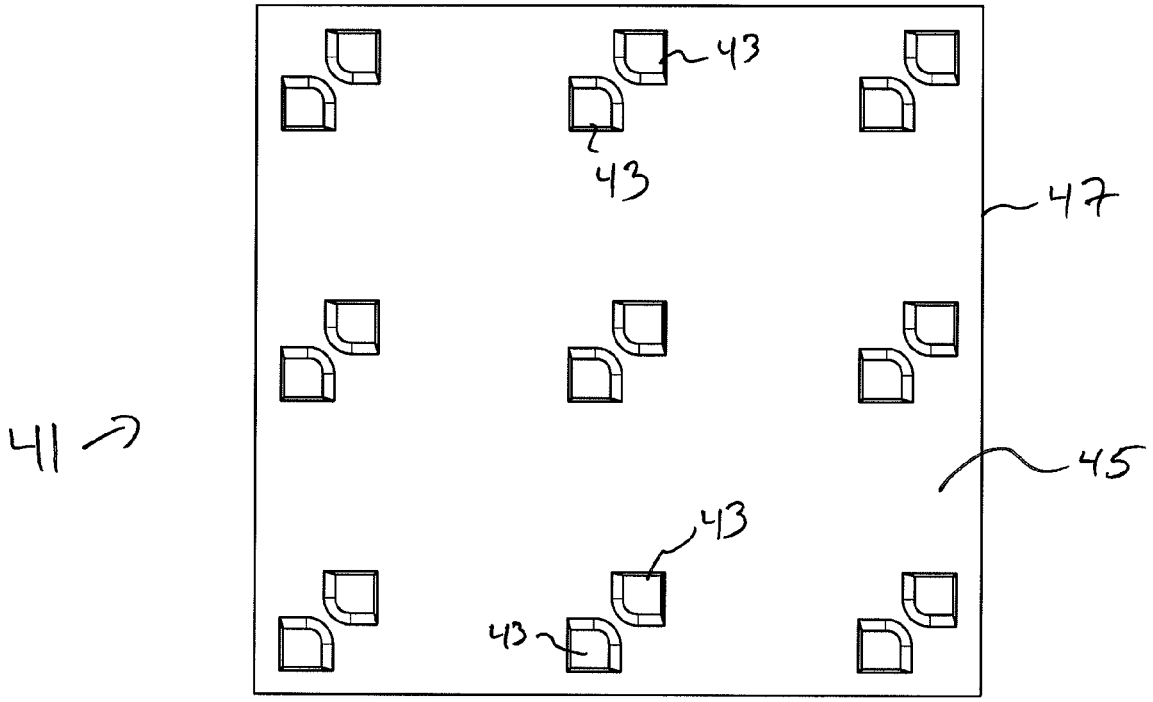
FIGS. 3A and 3B are a bottom plan view and a perspective view, respectively, of the bottom surface or structure of a first pallet design that can be stacked on the top caps of the present invention.
Figure 3B:
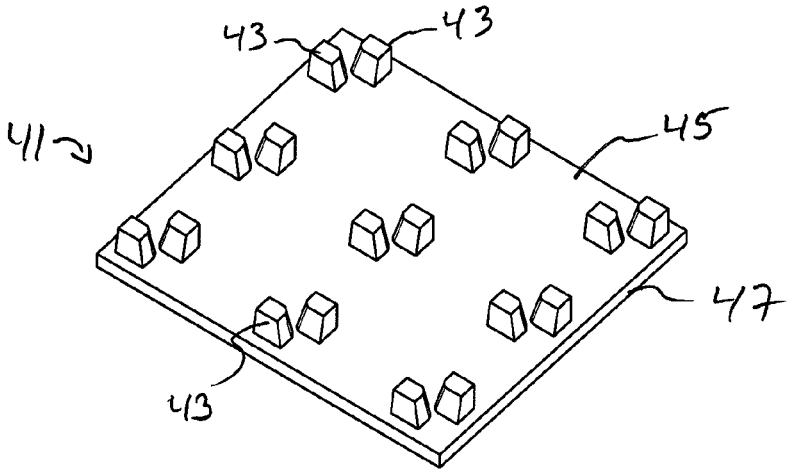

FIG. 3A shows a bottom plan view of the footprint of the bottom surface or structure 41 of the ORBIS® 45×48-A CISF and 45×48-B CISF pallets 47 (both pallets have the identical bottom surface or structure). FIG. 3B provides a prospective view of the bottom surface or structure 41. The bottom surface or structure 41 includes a plurality of legs 43 which extend from the bottom surface 45 of the pallet 47. The legs 43 are grouped in pairs which are arranged in three rows or columns. The pallet 47 is a molded plastic having a plurality of ribs (not shown) which also extend from the bottom surface 45.

Figure 4A:
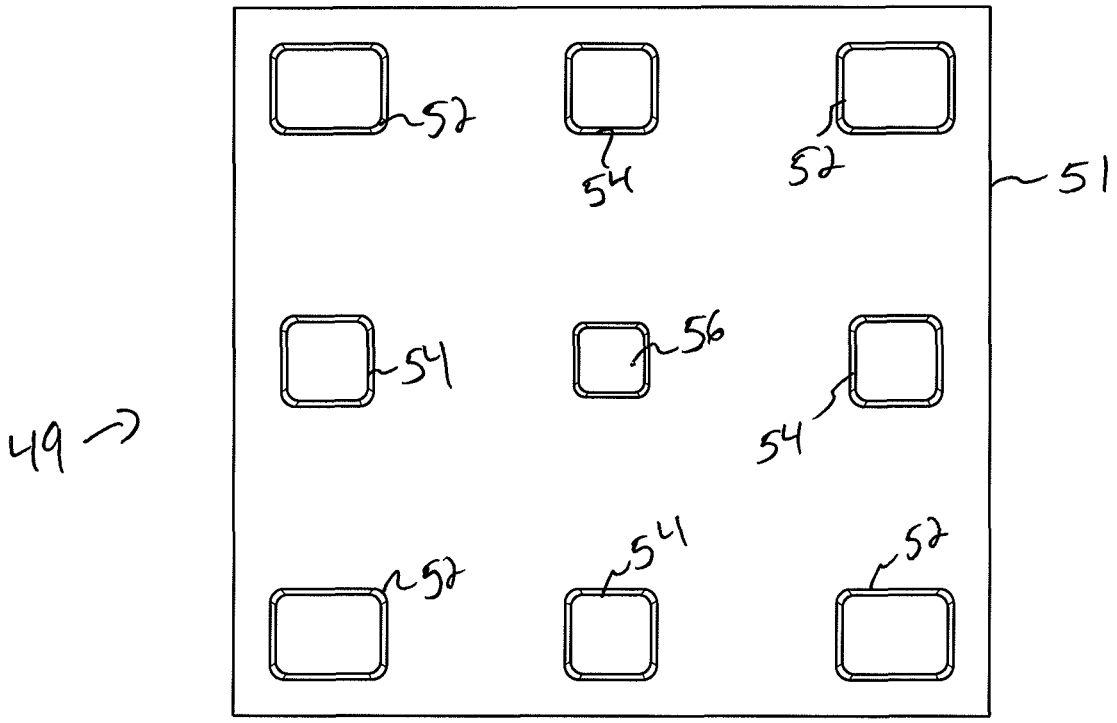
FIGS. 4A and 4B are a bottom plan view and a perspective view, respectively, of the bottom surface or structure of a second pallet design that can be stacked on the top caps of the present invention.
Figure 4B:
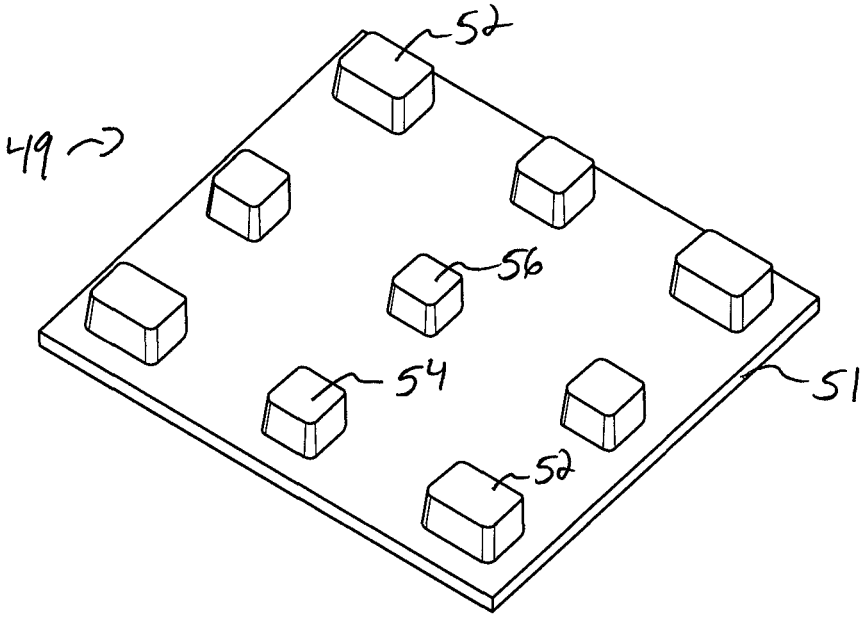

FIG. 4A shows a bottom plan view of the footprint of the bottom surface or structure 49 of the ORBIS® 45×48-C CISF pallet 51. FIG. 4B provides a perspective view of the bottom surface or structure 49 The bottom surface or structure includes legs 52, 54, 56 extending from a bottom surface 58. The legs 52 positioned proximate the corners of the pallet 51 are larger (i.e., have a larger cross-section) than the legs 54 positioned between the corners, which in turn, are larger than the leg 56 positioned in the center of the pallet 51.

Figure 5A:
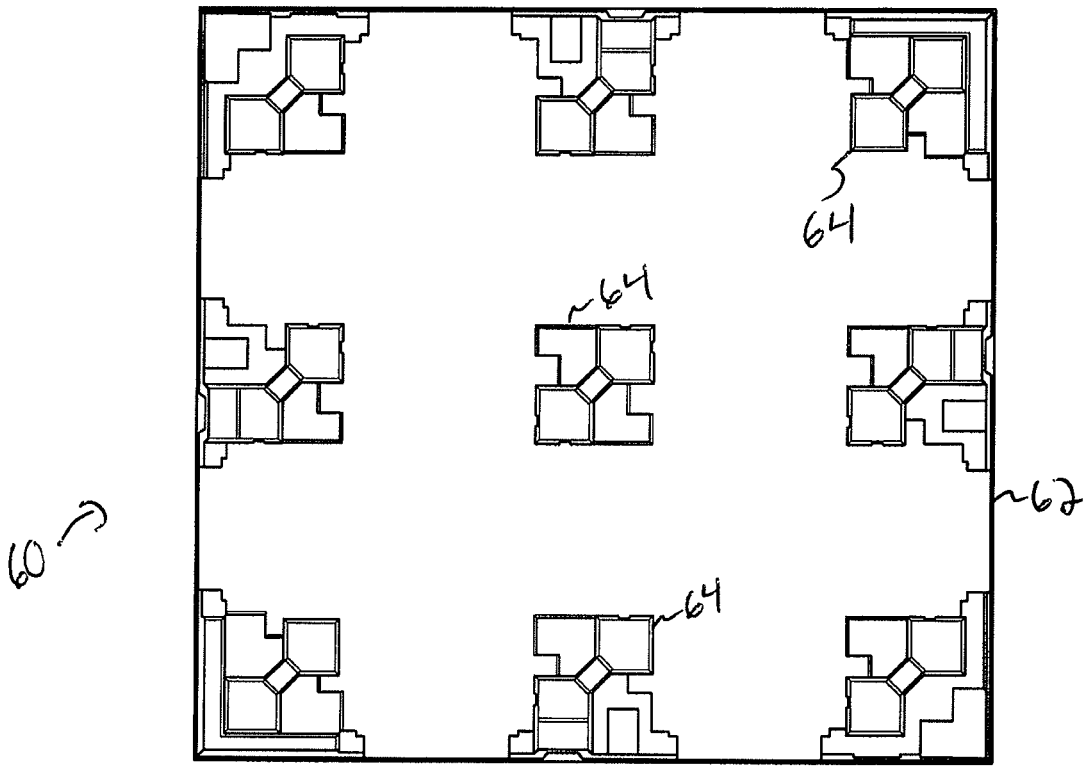
FIGS. 5A and 5B are a bottom plan view and a perspective view, respectively, of the bottom surface or structure of a third pallet design that can be stacked on the top caps of the present invention.
Figure 5B:
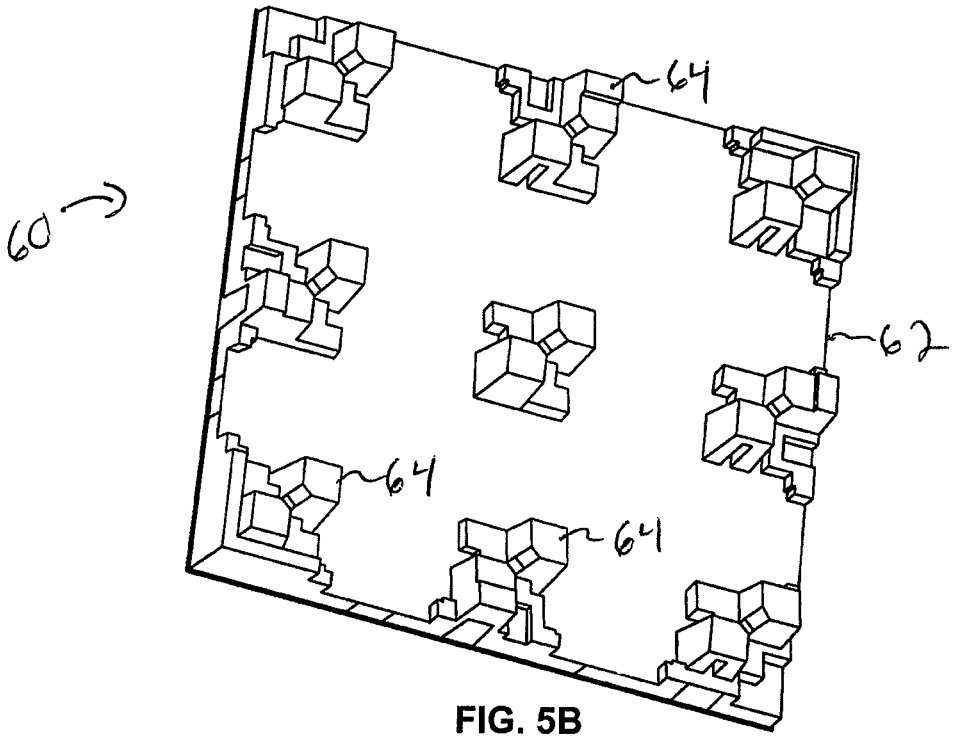

FIG. 5A shows a bottom plan view of the footprint of the bottom surface or structure 60 of the ORBIS® 45×48-2 CISS pallet 62. FIG. 5B provides a perspective view of the bottom surface or structure 60. The pallet includes legs 64 having a more complex shape than the legs of the pallets of FIGS. 3A, 3B, 4A and 4B.

Figure 6A:
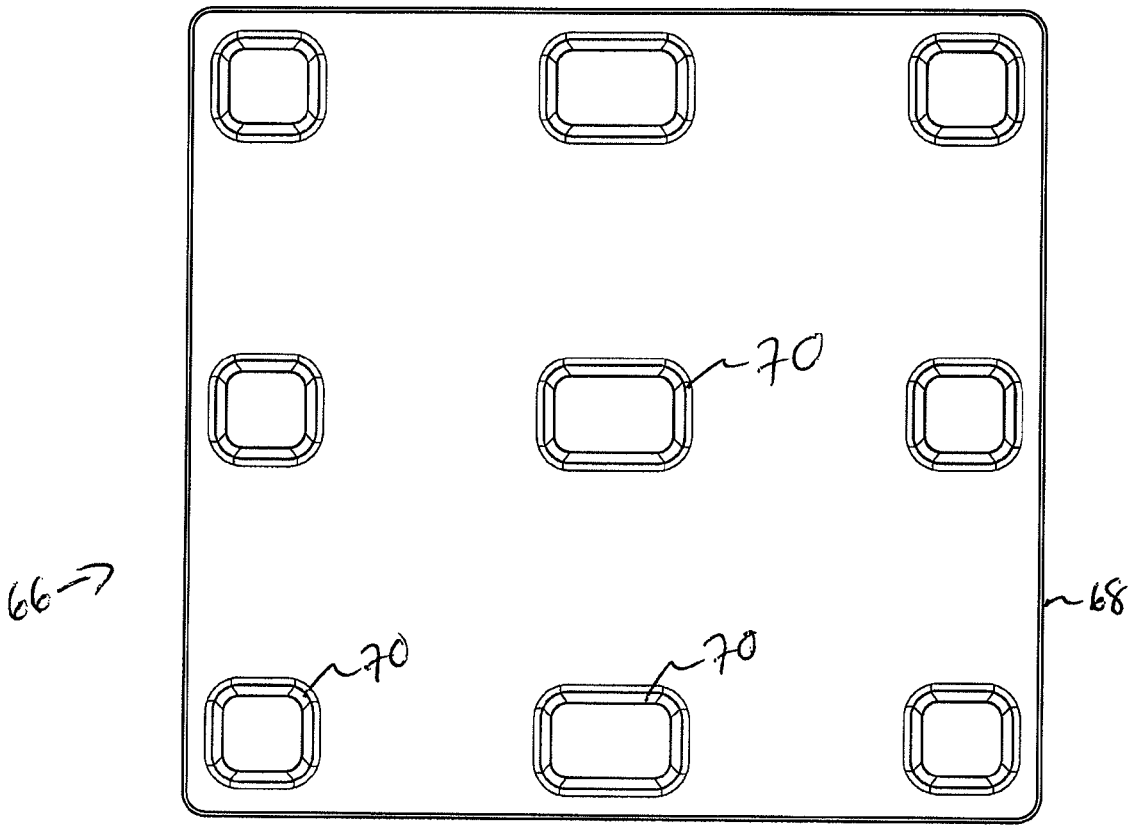
FIGS. 6A and 6B are a bottom plan view and a perspective view, respectively, of the bottom surface or structure of a fourth pallet design that can be stacked on the top caps of the present invention.

FIG. 6A shows a bottom plan view of the footprint of the bottom surface or structure 66 of the ORBIS® 45×48 Powerlite™ pallet 68. This pallet 68 includes legs 70.

Figure 7A:
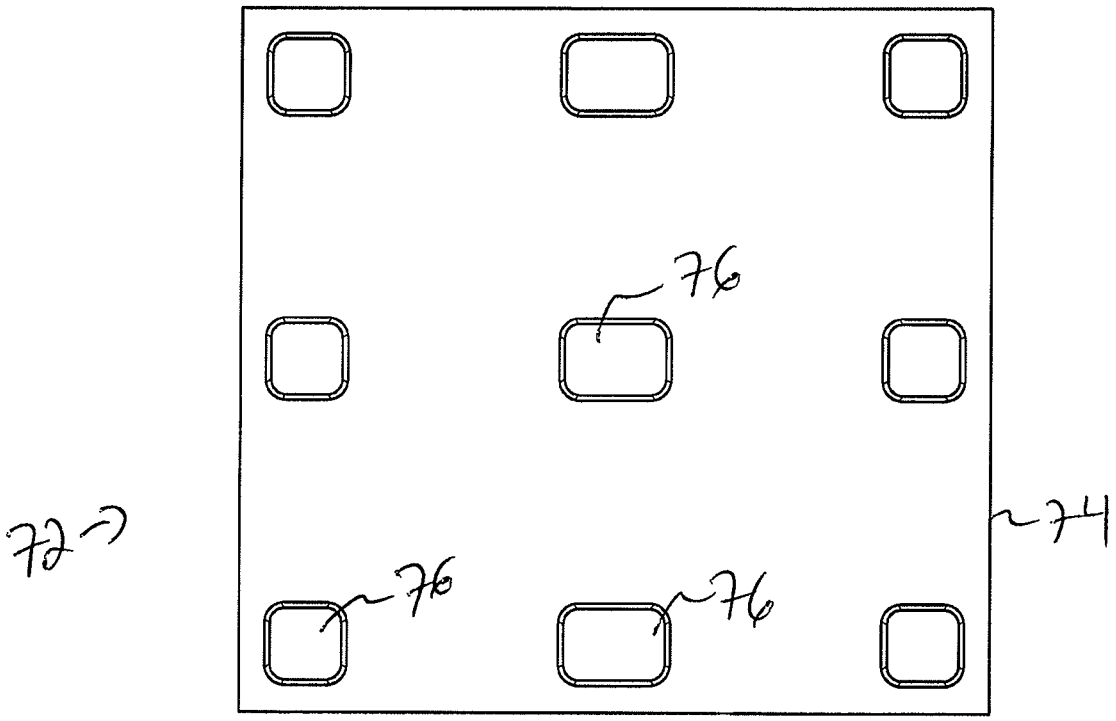
FIGS. 7A and 7B are a bottom plan view and a perspective view, respectively, of the bottom surface or structure of a fifth pallet design that can be stacked on the top caps of the present invention.
Figure 7B:
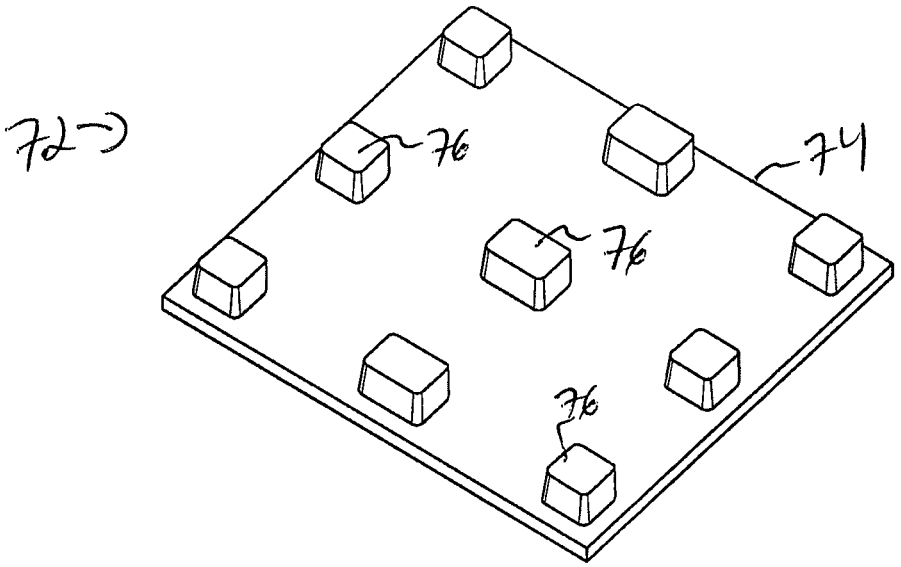

FIG. 7A shows a bottom plan view of the footprint of the bottom surface or structure 72 of the ORBIS® 45×48 AutoPal™ pallet 74, and FIG. 7B shows a perspective view of the pallet 72. This pallet 74 includes legs 76. The ORBIS® 45×48 AutoPal™ pallet 74 has the same footprint as the Schaefer 45×48 AutoPal™ pallet.

Figure 8A:
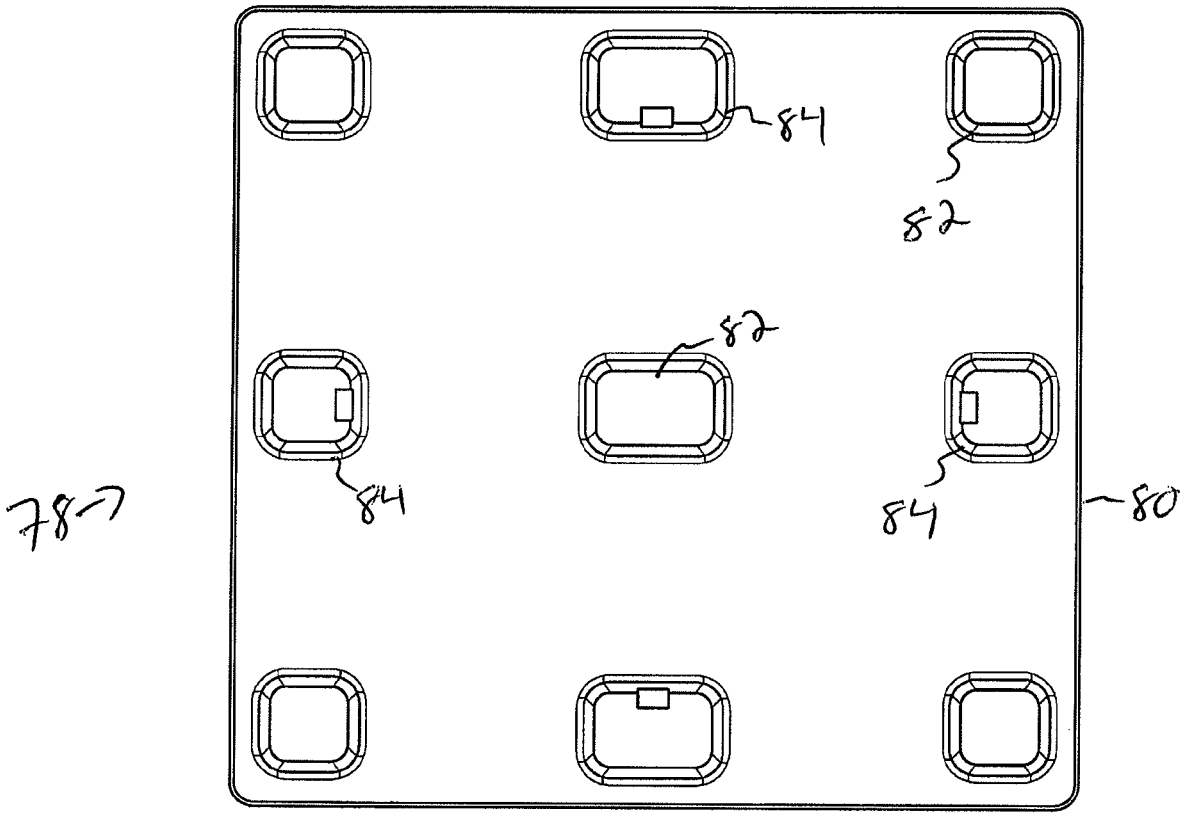
FIGS. 8A and 8B are a bottom plan view and a perspective view, respectively, of the bottom surface or structure of a sixth pallet design that can be stacked on the top caps of the present invention.
Figure 8B:
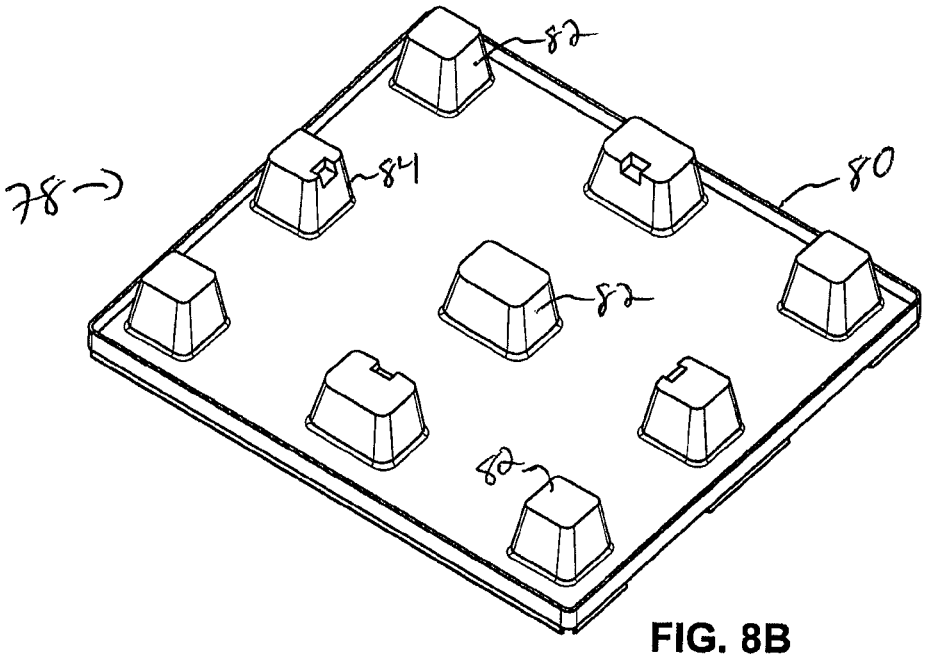

FIG. 8A shows a bottom plan view of the footprint of the bottom surface or structure 78 of the Schaefer 45×48 Krypto-Lite® pallet 80, and FIG. 8B shows a perspective view of the pallet 80. This pallet includes legs 82 having a rectangular cross-section and legs 84 having a notch or cut-out at the bottom of the leg.

The top caps 10, 30 are also preferably designed to allow the following bulk bins to securely stack onto the top surfaces 12, 32: ORBIS® 45×48 Heavy Duty and Medium Duty bulk bins, and Buckhorn 45×48 bulk bins.

Figure 9A:
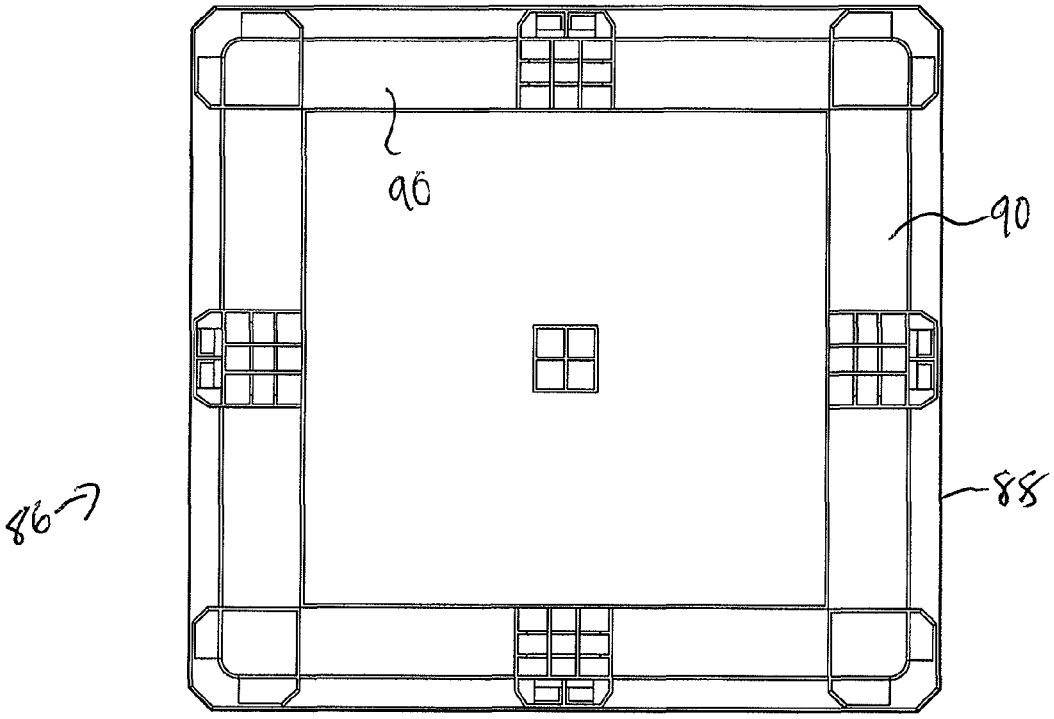
FIGS. 9A and 9B are a bottom plan view and a perspective view, respectively, of the bottom surface or structure of a first bulk bin design that can be stacked on the top caps of the present invention.
Figure 9B:
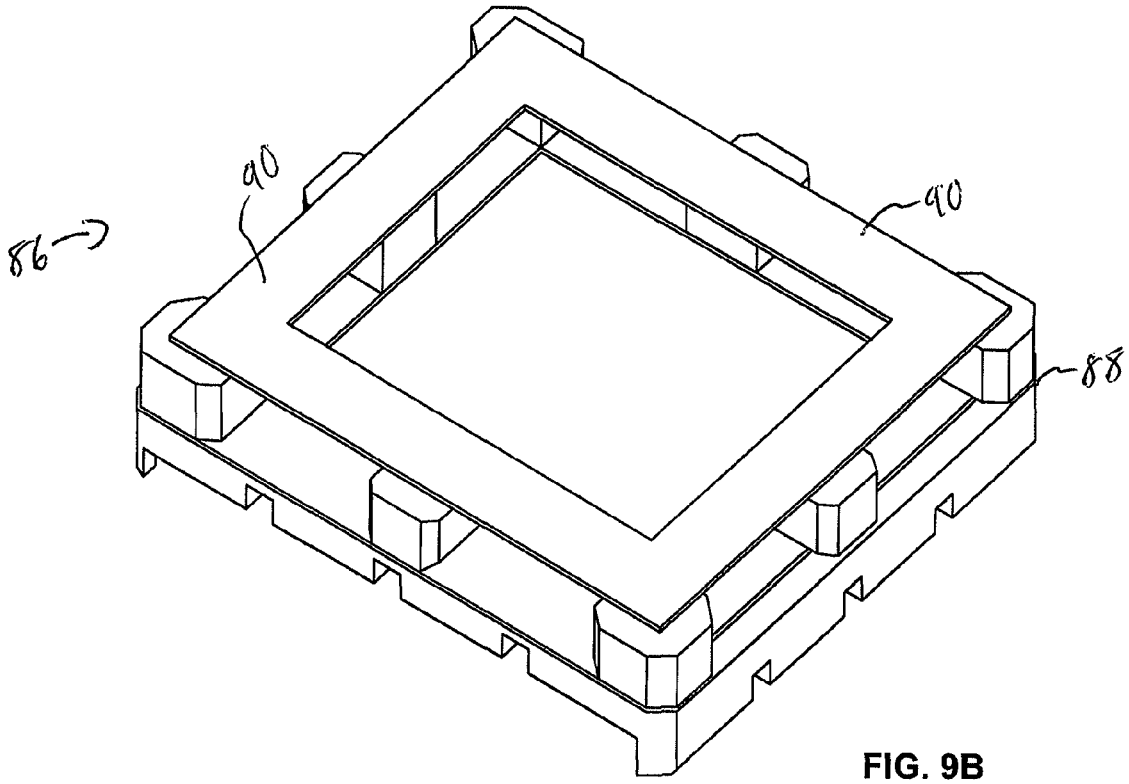

FIG. 9A provides a bottom plan view of the bottom surface or structure 86 of the ORBIS® HD45×48 Medium Duty bulk bin 88. FIG. 9B is a perspective view of the bulk bin 88. This bulk bin 88 includes stringers 90 extending along an outer periphery of the bottom surface of the bin 88.

Figure 10A:
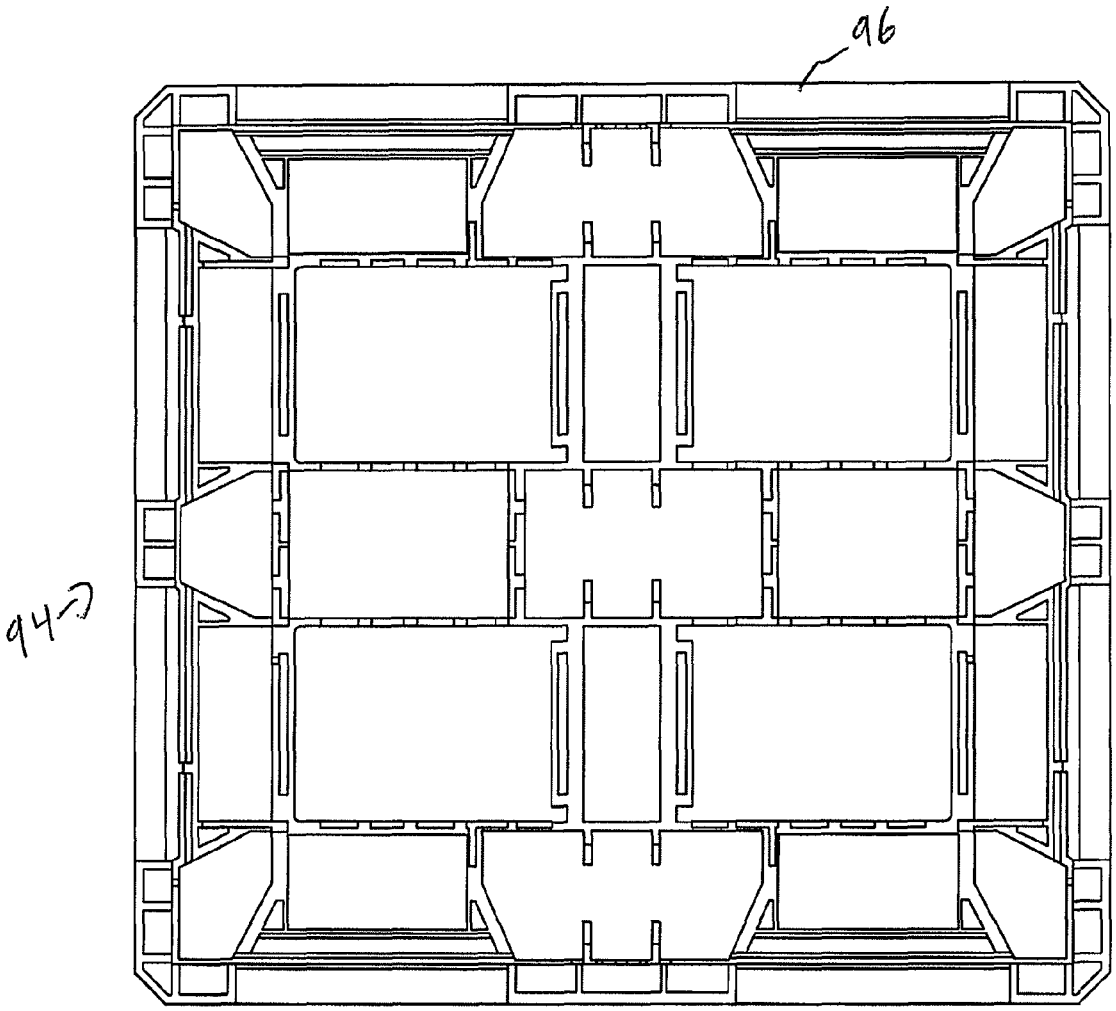
FIGS. 10A and 10B are a bottom plan view and a perspective view, respectively, of the bottom surface or structure of a second bulk bin design that can be stacked on the top caps of the present invention.
Figure 10B:
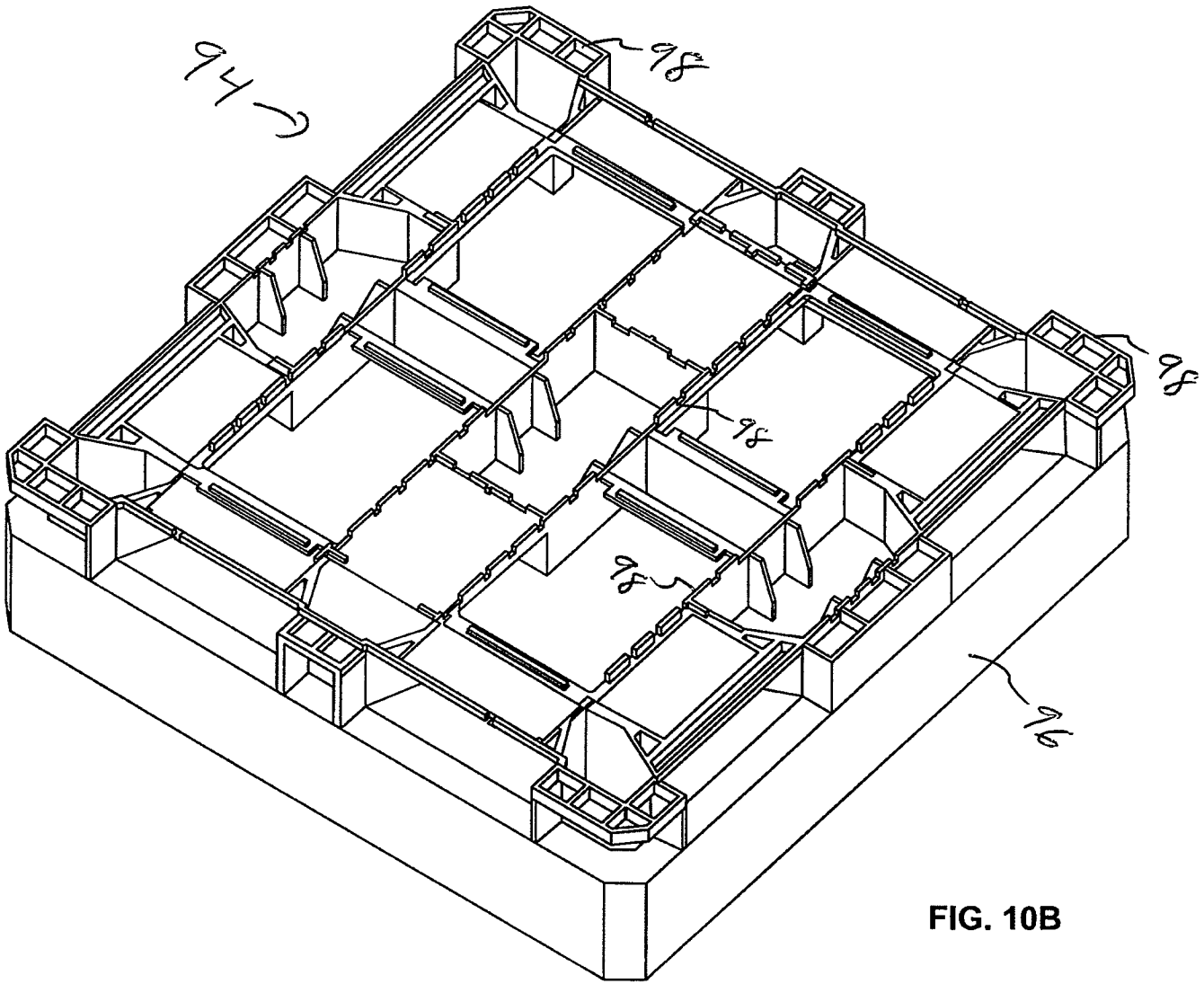

FIG. 10A provides a bottom plan view of the bottom surface or structure 94 of the ORBIS® HD45×48 Heavy-Duty bulk bin 96. FIG. 10B is a perspective view of the bulk bin 96. This bulk bin 96 includes feet 98.

Figure 11A:
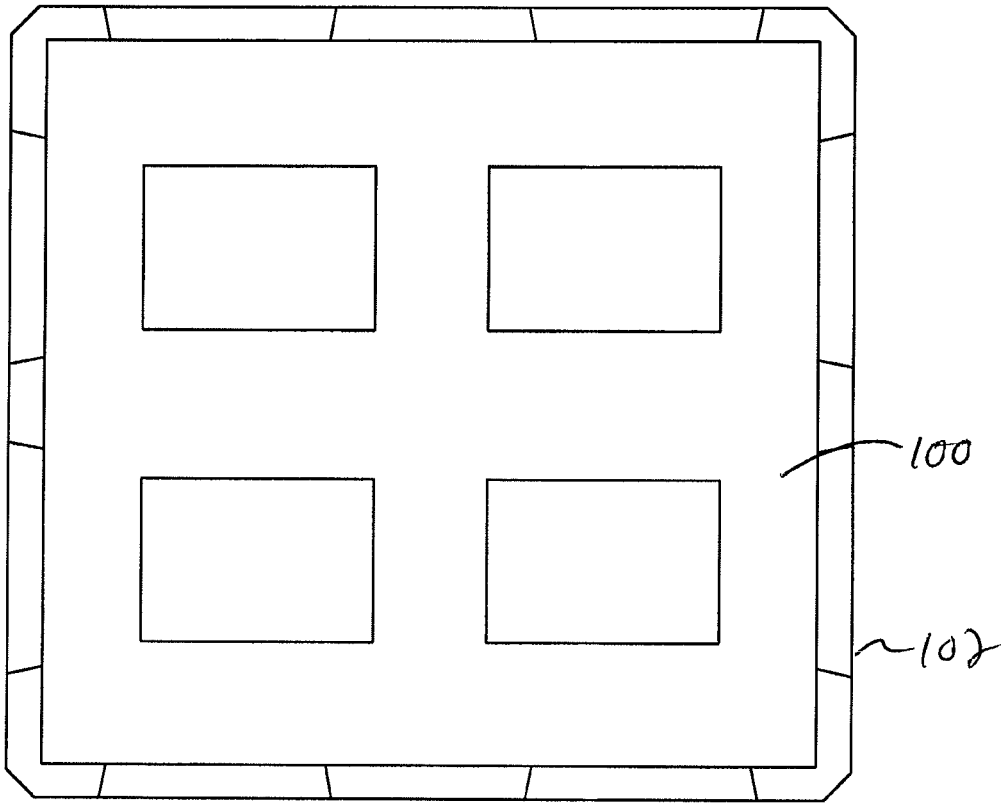
FIGS. 11A and 11B are a bottom plan view and a perspective view, respectively, of the bottom surface or structure of a third bin design that can be stacked on the top caps of the present invention.
Figure 11B:
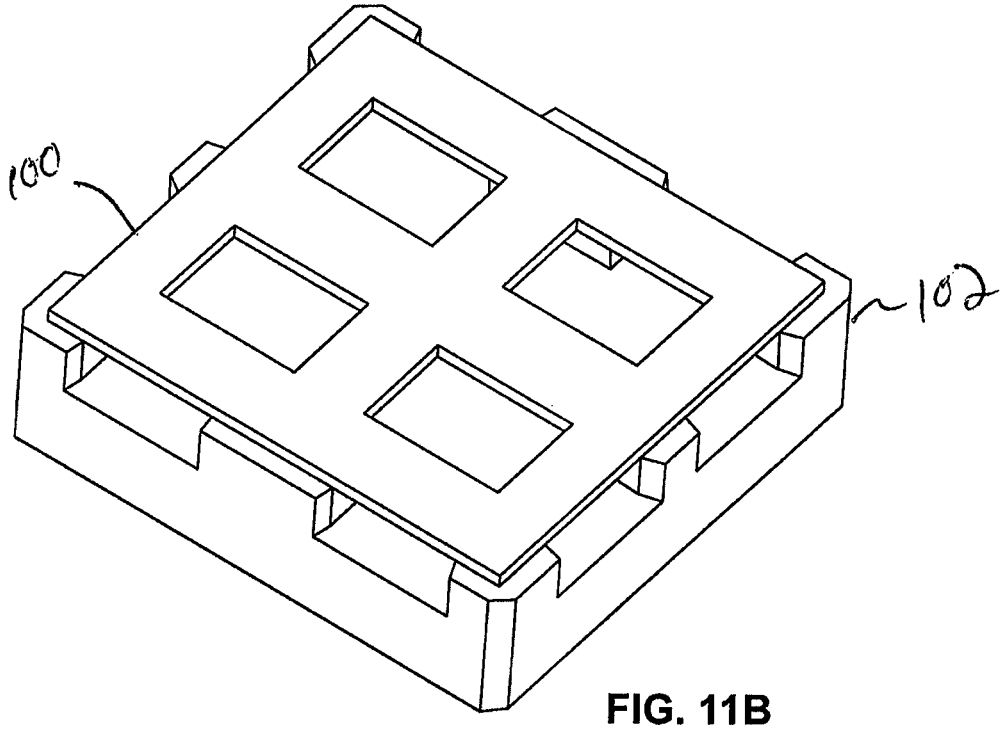

FIG. 11A shows a bottom plan view of the bottom surface or structure 100 of the ORBIS® HDR45×48 Heavy Duty bulk bin 102. FIG. 11B is a perspective view of the bulk bin 102. Both Figures show a simplified representation of the bottom surface or structure 100. The actual bulk bin 102 has a more complicated structure similar to that shown in FIGS. 10A and 10B.

Figure 12A:
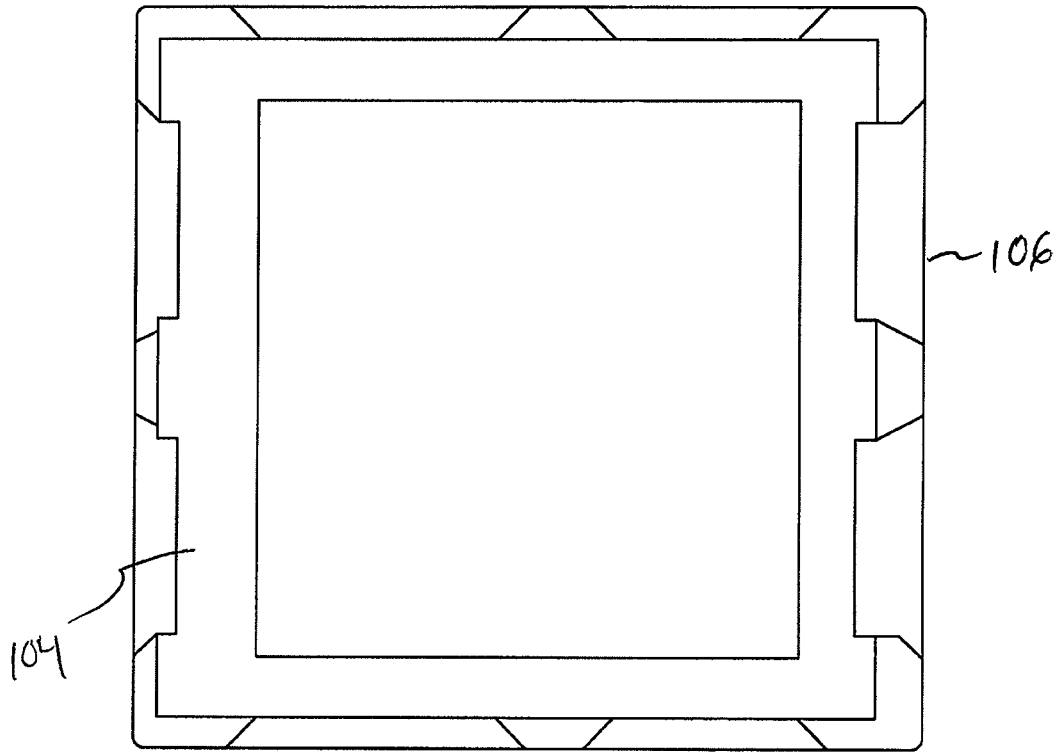
FIGS. 12A and 12B are a bottom plan view and a perspective view, respectively, of the bottom surface or structure of a fourth bulk bin design that can be stacked on the top caps of the present invention.
Figure 12B:
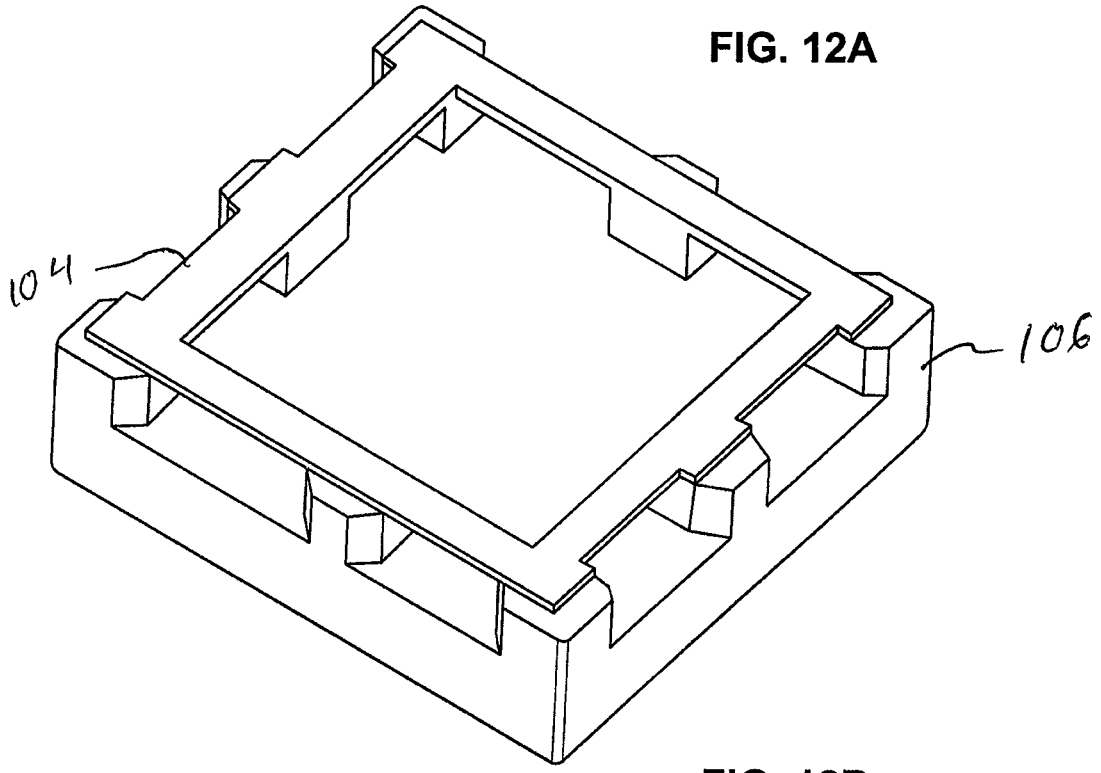

FIG. 12A shows a bottom plan view of the bottom surface or structure 104 of the Buckhorn 45×48 bulk bin 106. FIG. 12B is a perspective view of the bulk bin 106. Both Figures show a simplified representation of the bottom surface or structure 104. The actual bulk bin 106 has a more complicated structure.

Figure 13A:
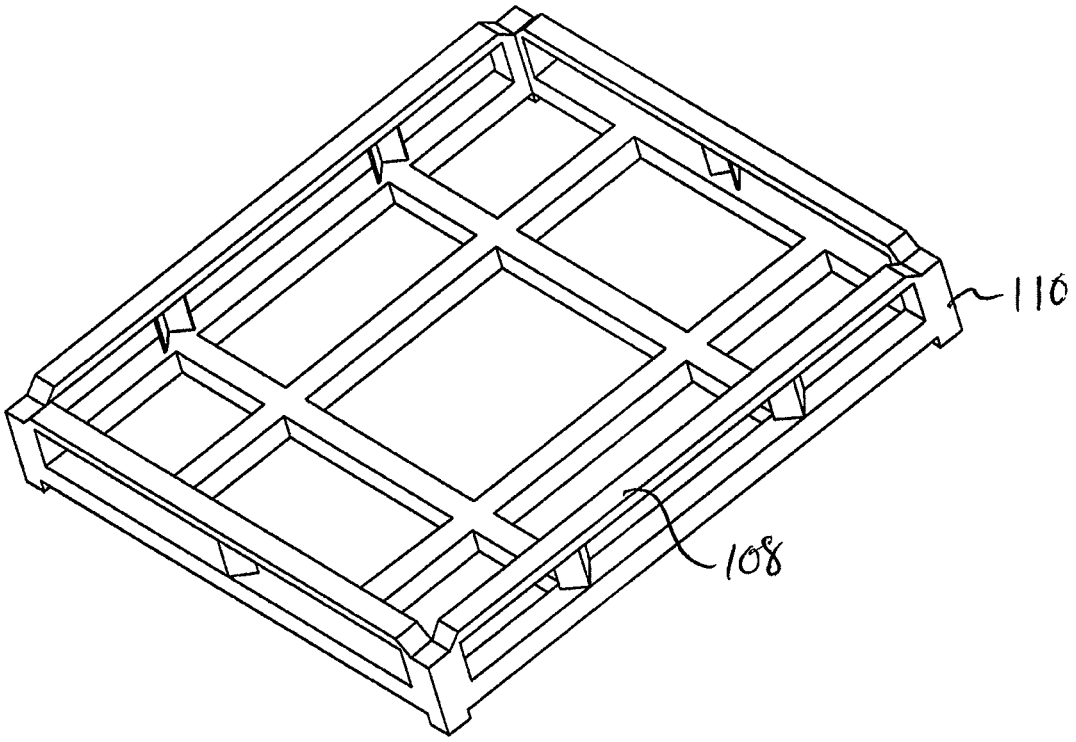
FIGS. 13A and 13B are a perspective view and a bottom plan view, respectively, of the bottom surface or structure of a first metal rack design that can be stacked on the top caps of the present invention.
Figure 13B:
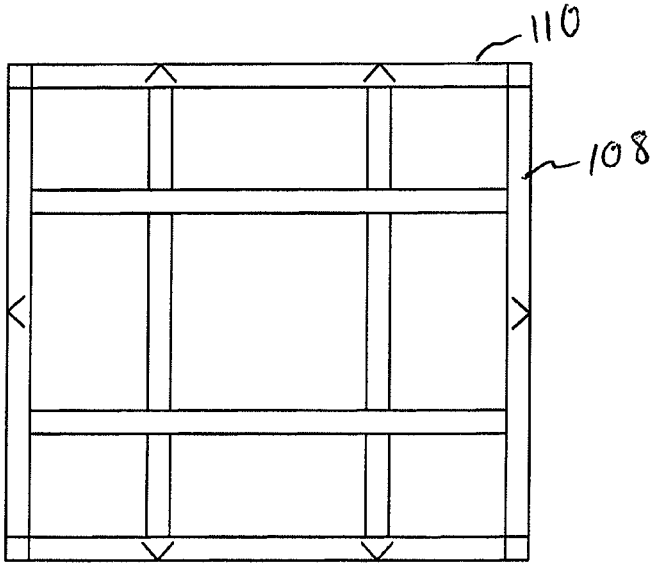

FIG. 13B provides a bottom plan view of the bottom surface or structure 108 of the 45×48 Steel Rack 110. FIG. 13A provides a perspective view of the steel rack 110.

Figure 14A:
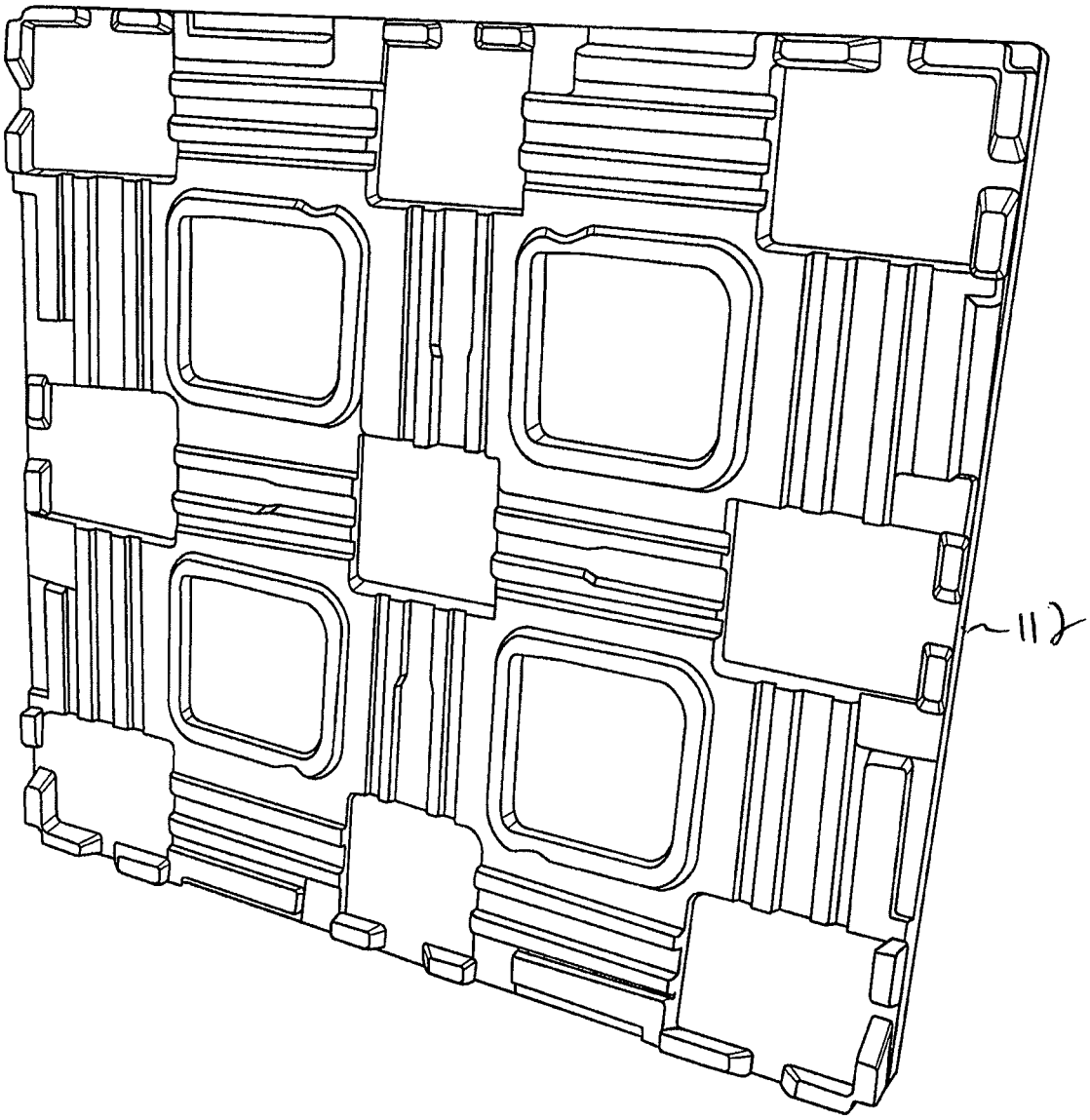
FIGS. 14A and 14B are a perspective view and a bottom plan view, respectively, of another model top cap that can nest with the top caps of the present invention.
Figure 14B:
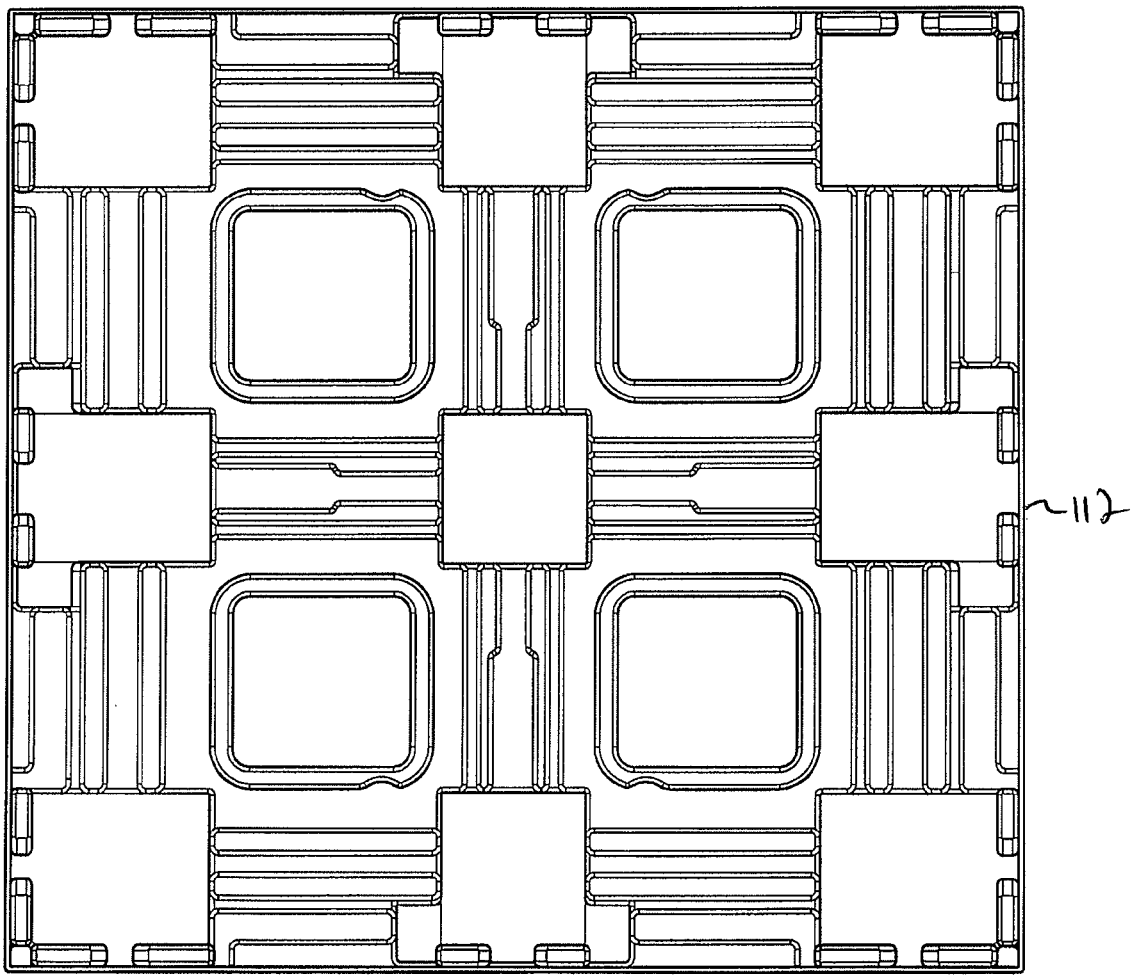

FIGS. 14A and 14B show a perspective view and a plan view, respectively, of another model top cap 112 (the ORBIS® MP2). The present top caps 10, 30 are configured to nest with this top cap 112 to provide greater shipping efficiencies when transporting the top caps 10, 30 and/or 112.

FIGS. 15(A and B)-26(A and B) provide a top perspective view of the top caps 10, 30, of the present invention, respectively, in a side-by-side arrangement. In each of these views, the footprint of the bottom surface or structures of the various pallets, bulk bins and metal rack is shown in phantom.

Figure 15B:
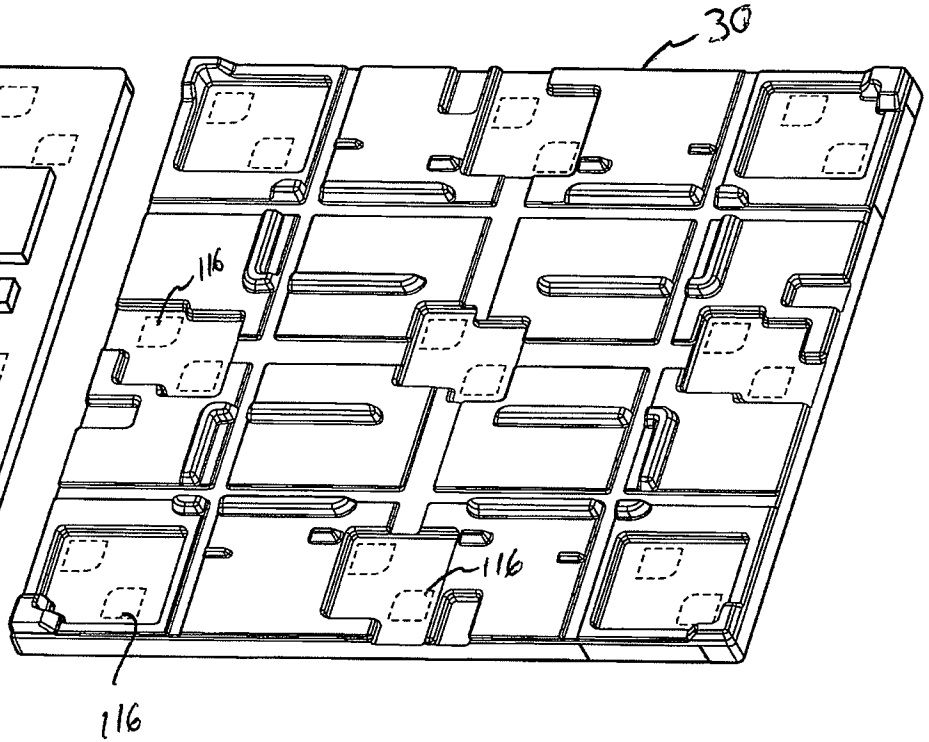
FIGS. 15A and 15B are a side by side view of the top caps of FIGS. 1 and 2 showing placement of the bottom surface or structure of the pallet of FIGS. 3A and 3B in phantom.
Figure 15A:
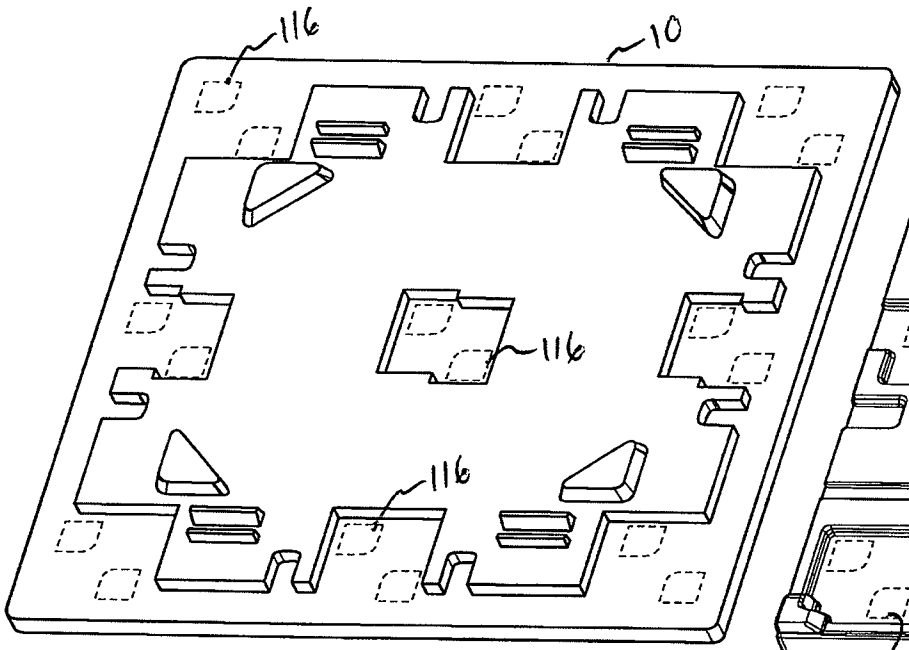

Specifically, FIGS. 15A and 15B show the footprint 116 (i.e., all of the shapes, collectively, shown in phantom) of the bottom surface or structure 41 of the ORBIS® 45×48-A CISF and 45×48-B CISF pallets 47 of FIGS. 3A and 3B. The legs 43 of the bottom surface or structure 41 are captured and supported by the raised and indented portions of the top caps 10, 30 in a manner that would prevent the pallets from slipping when stacked on the top caps 10, 30.

Figure 16B:
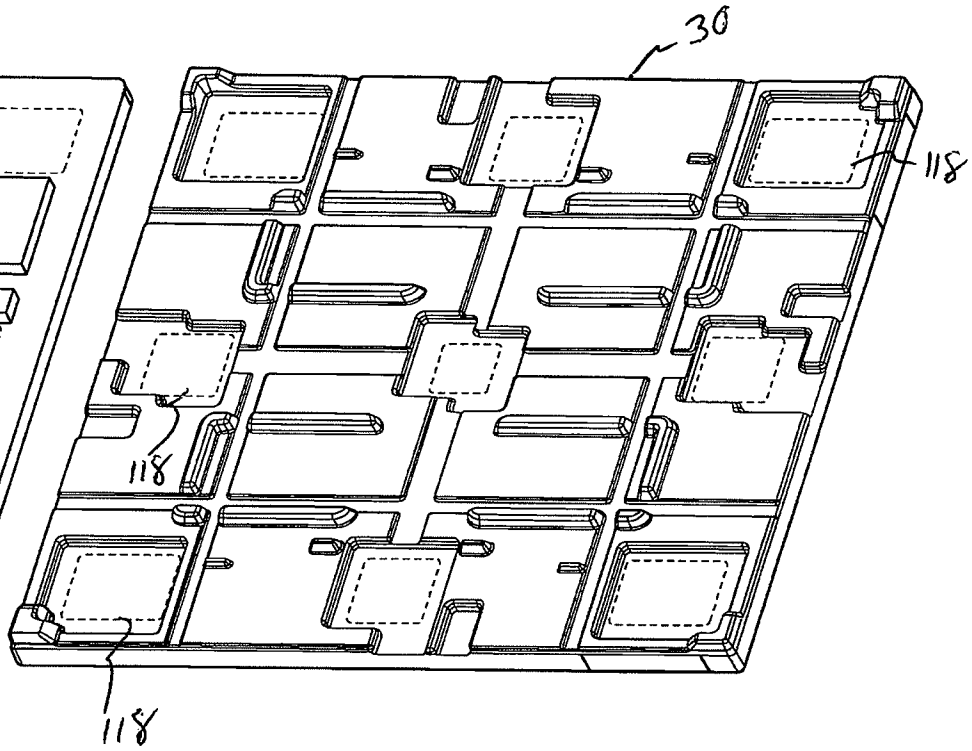
FIGS. 16A and 16B are a side by side view of the top caps of FIGS. 1 and 2 showing placement of the bottom surface or structure of the pallet of FIGS. 4A and 4B in phantom.
Figure 16A:
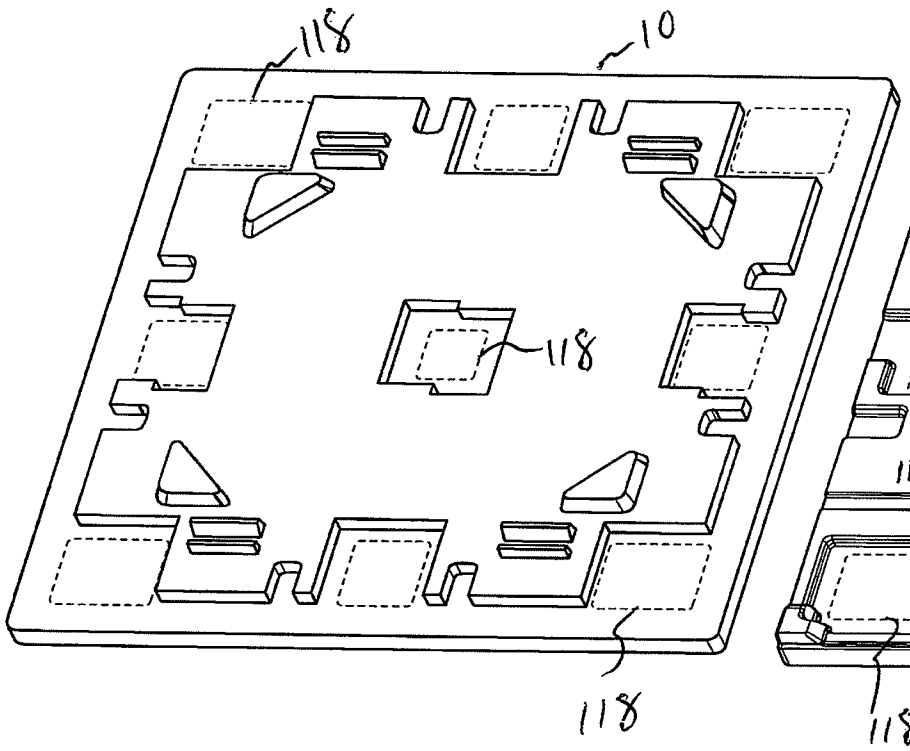

FIGS. 16A and 16B provide the footprint 118 of the bottom surface or structure 48 of the ORBIS® 45×48-C CISF pallet 51 shown in FIGS. 4A and 4B. Again, the raised and indented portions of the top caps 10, 30 are designed to capture and support the bottom surface or structure 49 to prevent the pallet 51 from slipping when stacked on the top caps 10, 30.

Figure 6B:
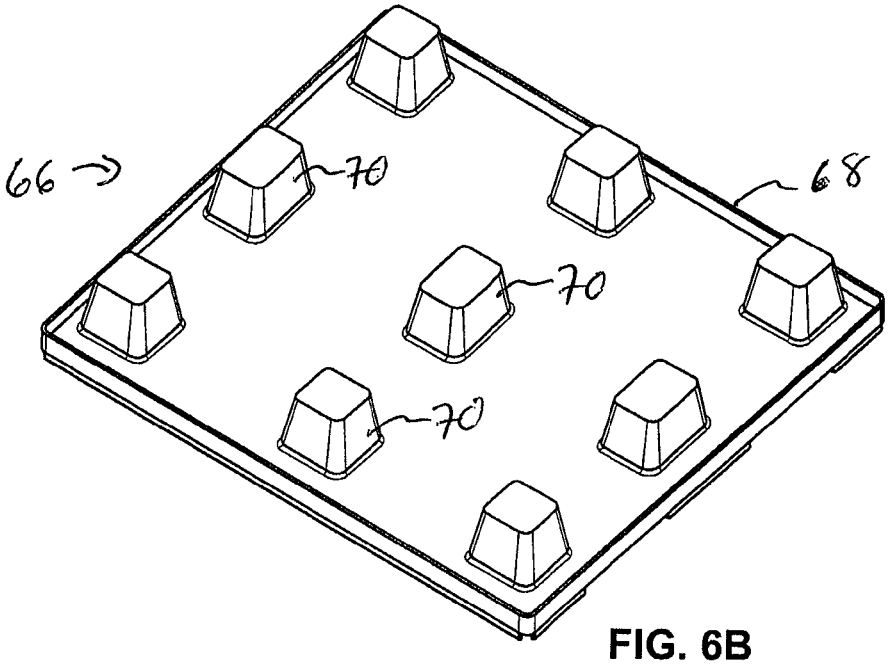
Figure 17B:
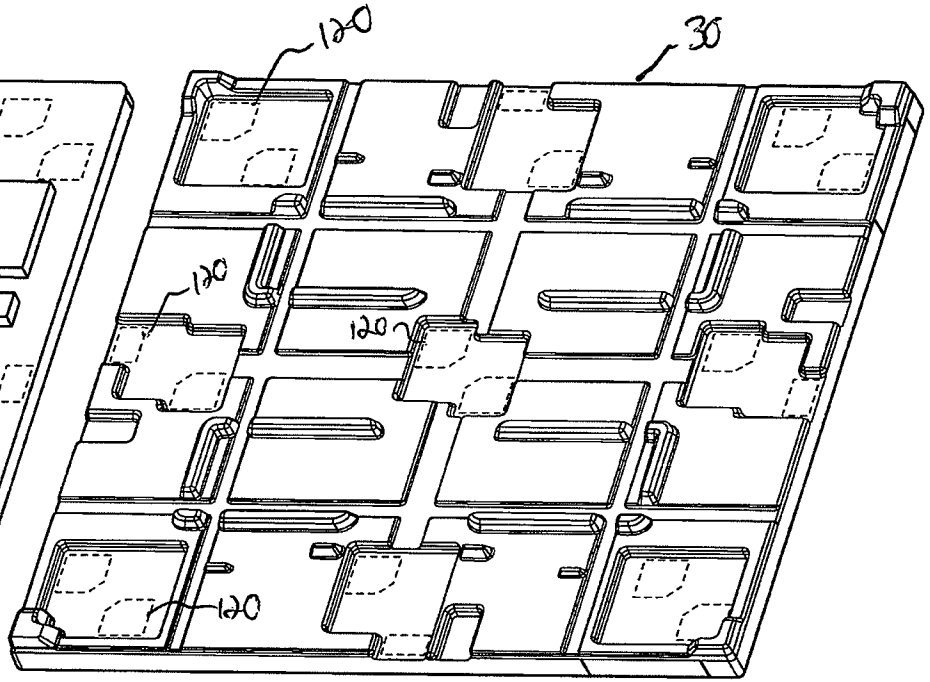
FIGS. 17A and 17B are a side by side view of the top caps of FIGS. 1 and 2 showing placement of the bottom surface or structure of the pallet of FIGS. 5A and 5B in phantom.
Figure 17A:
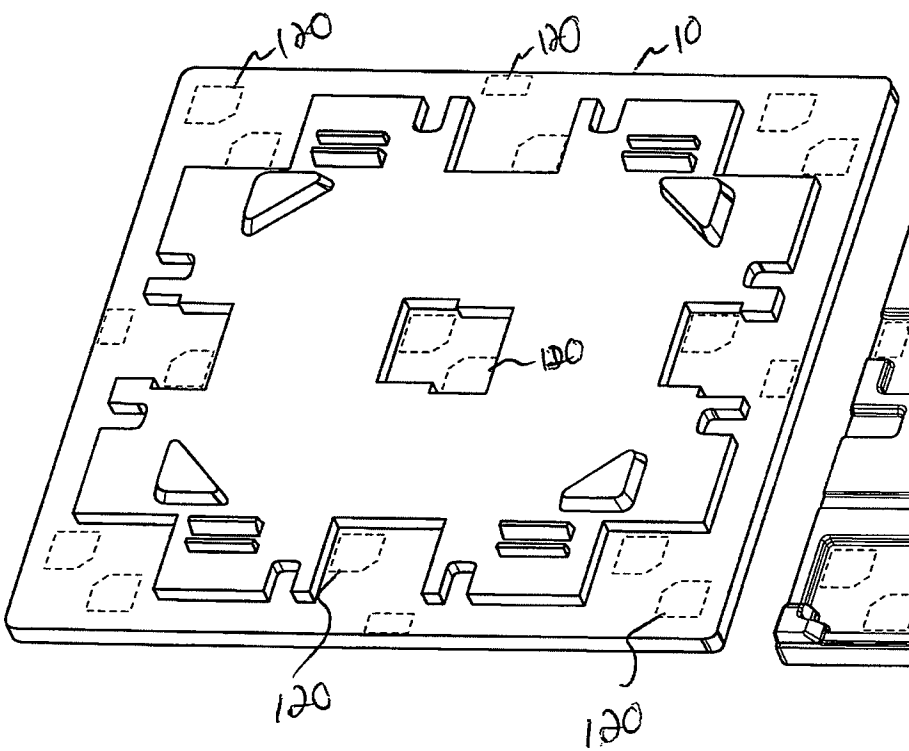
Figure 18B:
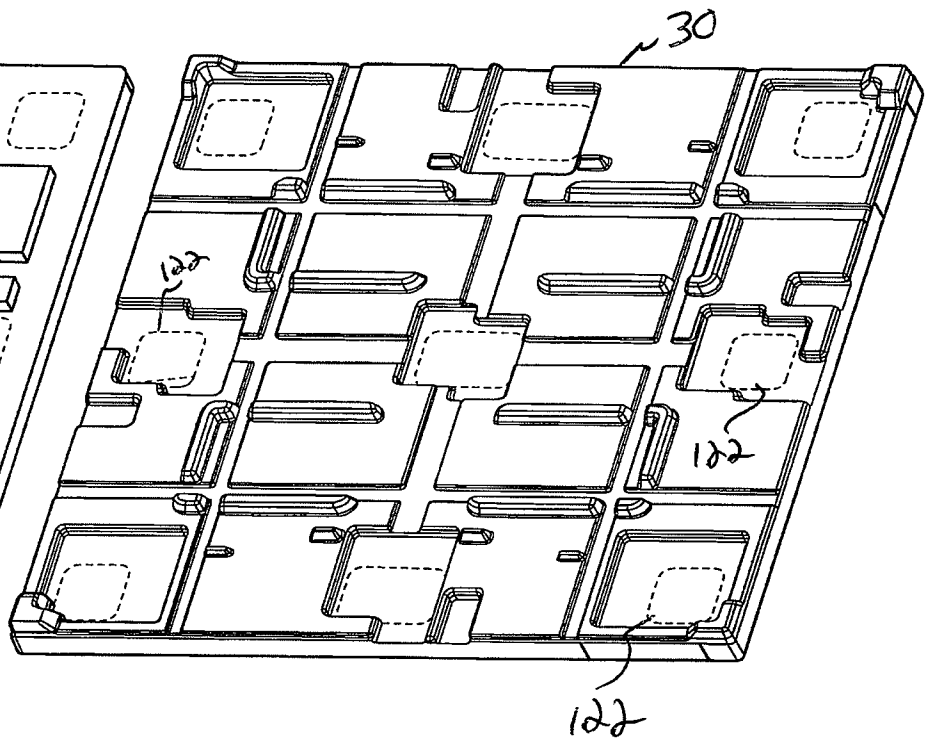
FIGS. 18A and 18B are a side by side view of the top caps of FIGS. 1 and 2 showing placement of the bottom surface or structure of the pallet of FIGS. 6A and 6B in phantom.
Figure 18A:
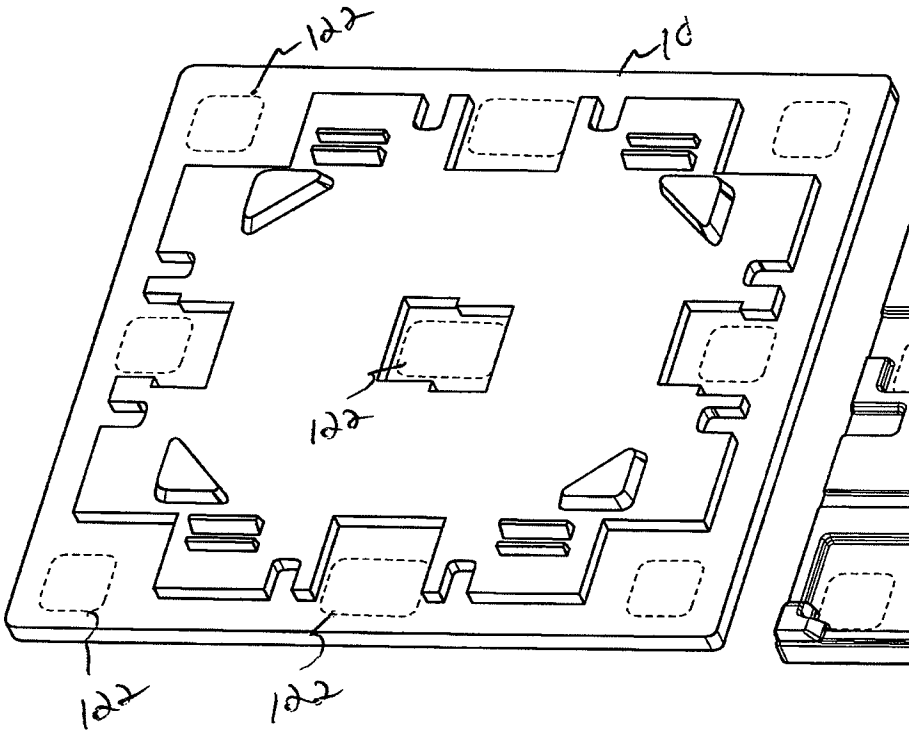
Figures 19A, 19B:
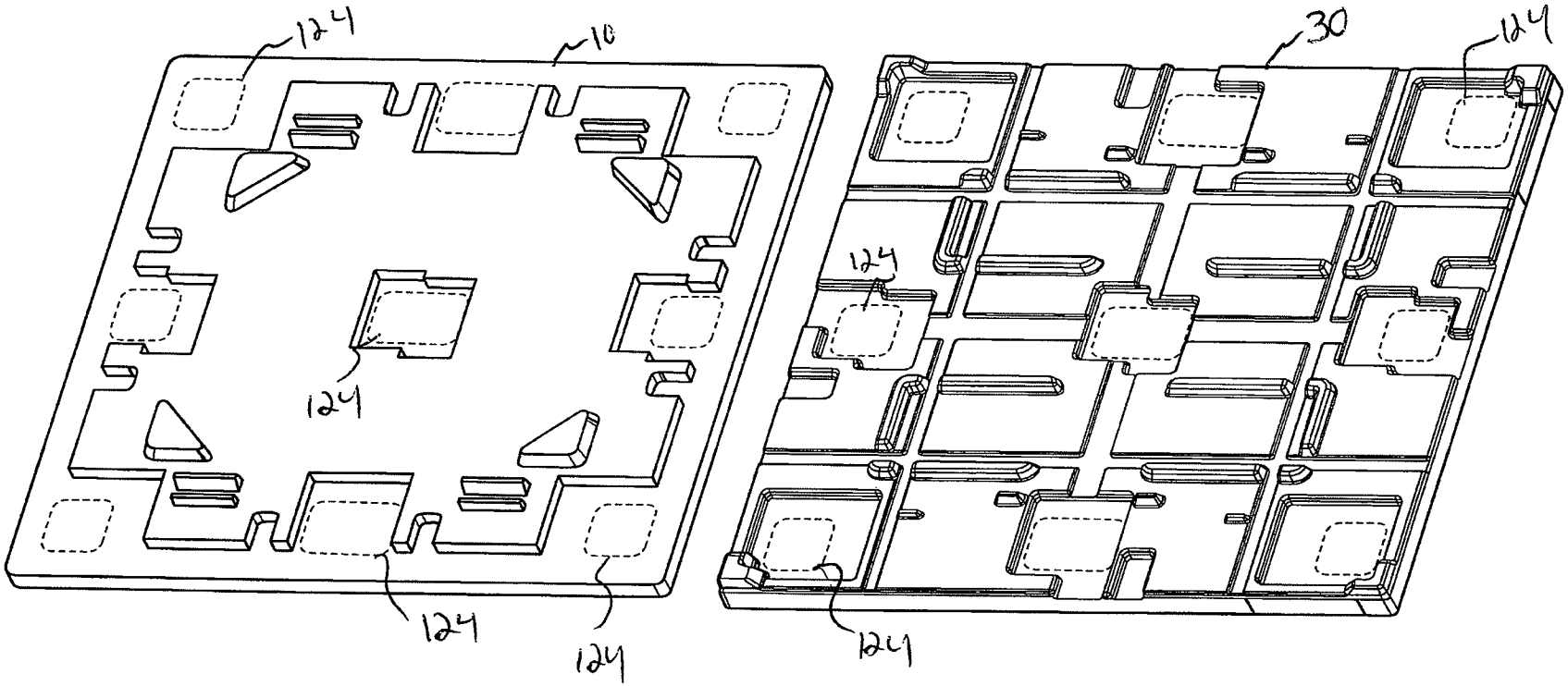
FIGS. 19A and 19B are a side by side view of the top caps of FIGS. 1 and 2 showing placement of the bottom surface or structure of the pallet of FIGS. 7A and 7B in phantom.
Figure 20B:
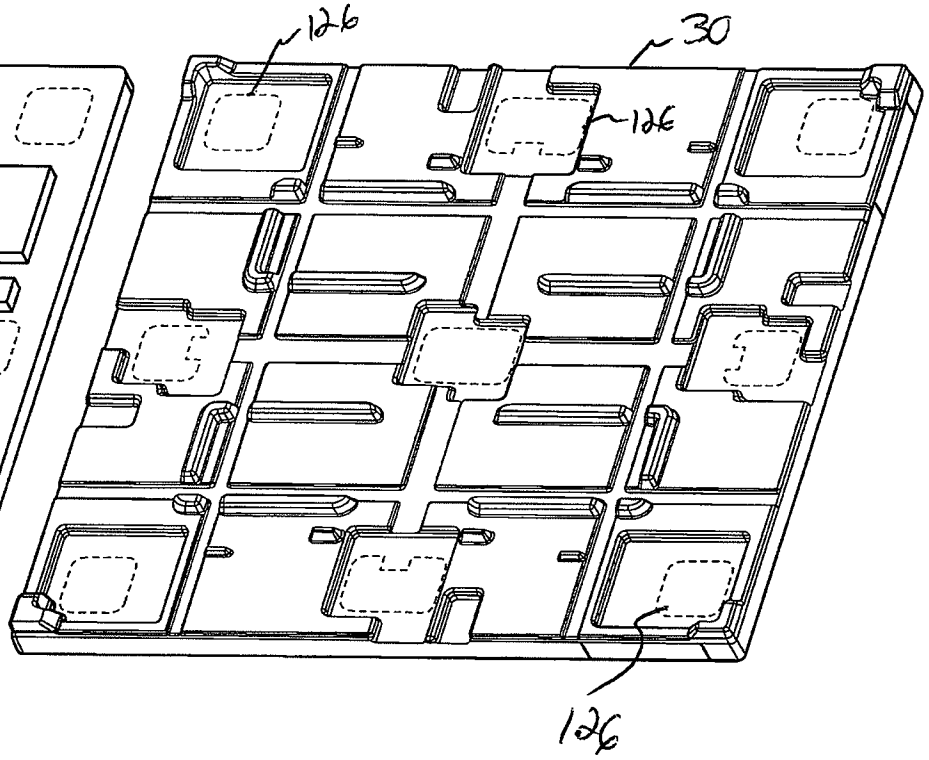
FIGS. 20A and 20B are a side by side view of the top caps of FIGS. 1 and 2 showing placement of the bottom surface or structure of the pallet of FIGS. 8A and 8B in phantom.
Figure 20A:
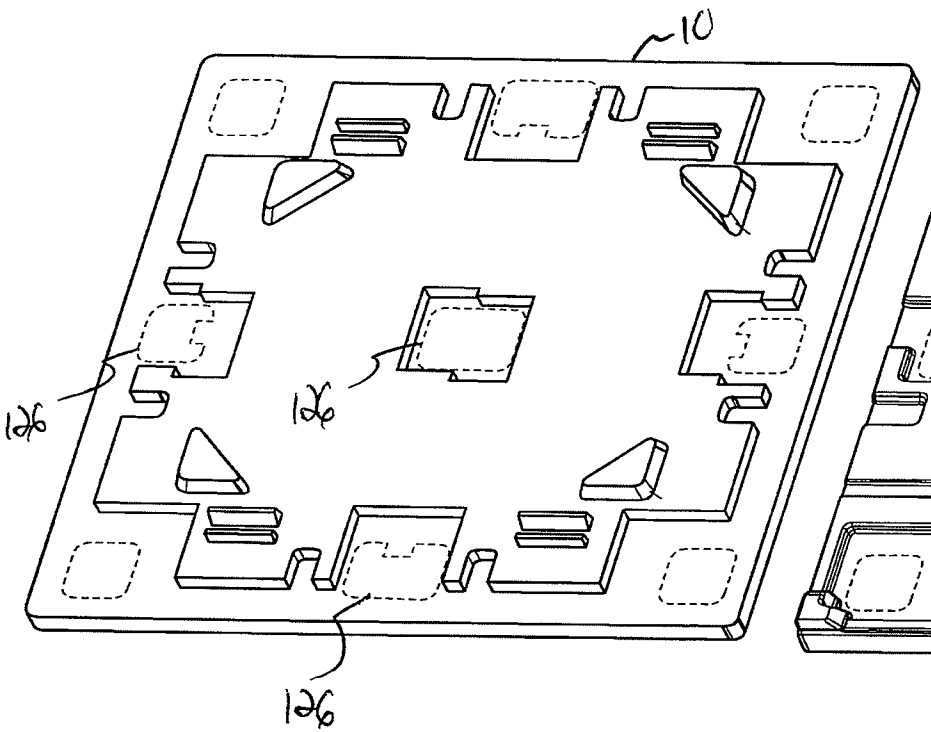

In like manner, FIGS. 17A and 17B provide the footprint 120 for the bottom surface or structure 60 of the ORBIS® 45×48-2 CISS pallet 62 shown in FIGS. 5A and 5B. FIGS. 18A and 18B provide the footprint 122 of the bottom surface or structure 66 of the ORBIS® 45×48 Powerlite™ pallet 68 shown in FIGS. 6A and 6B. FIGS. 19A and 19B provide the footprint 124 of the bottom surface or structure 72 of the ORBIS® 45×48 AutoPal™ pallet 74 shown in FIGS. 7A and 7B. FIGS. 20A and 20B provide the footprint 126 of the bottom surface or structure 78 of the Schaefer 45×48 Krypto-Lite® pallet 80 shown in FIGS. 8A and 8B.

Figure 21B:
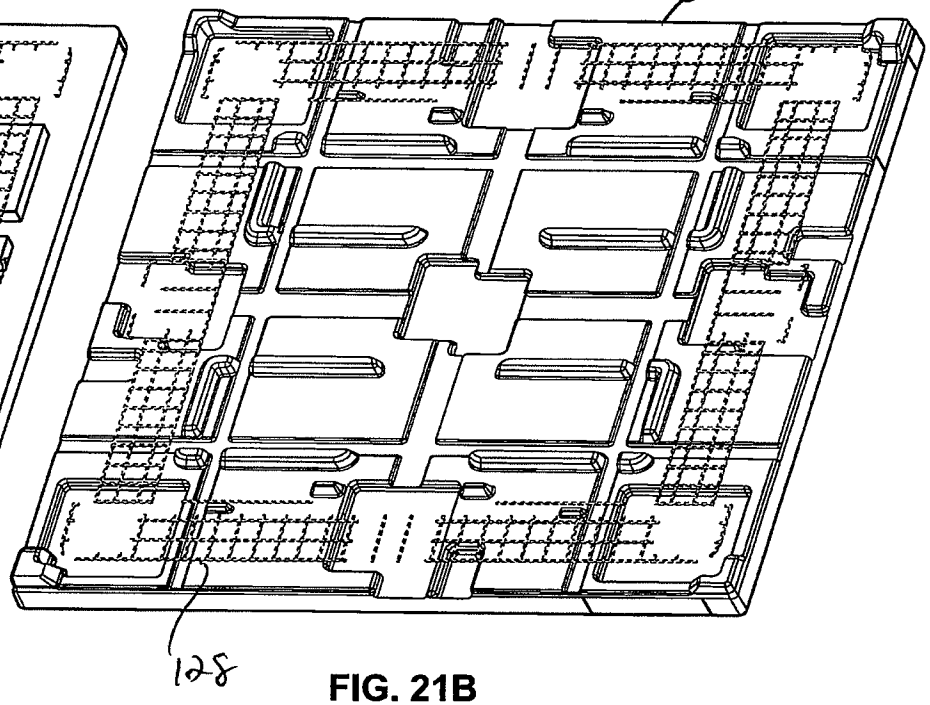
FIGS. 21A and 21B are a side by side view of the top caps of FIGS. 1 and 2 showing placement of the bottom surface or structure of the bulk bin of FIGS. 9A and 9B in phantom.
Figure 21A:
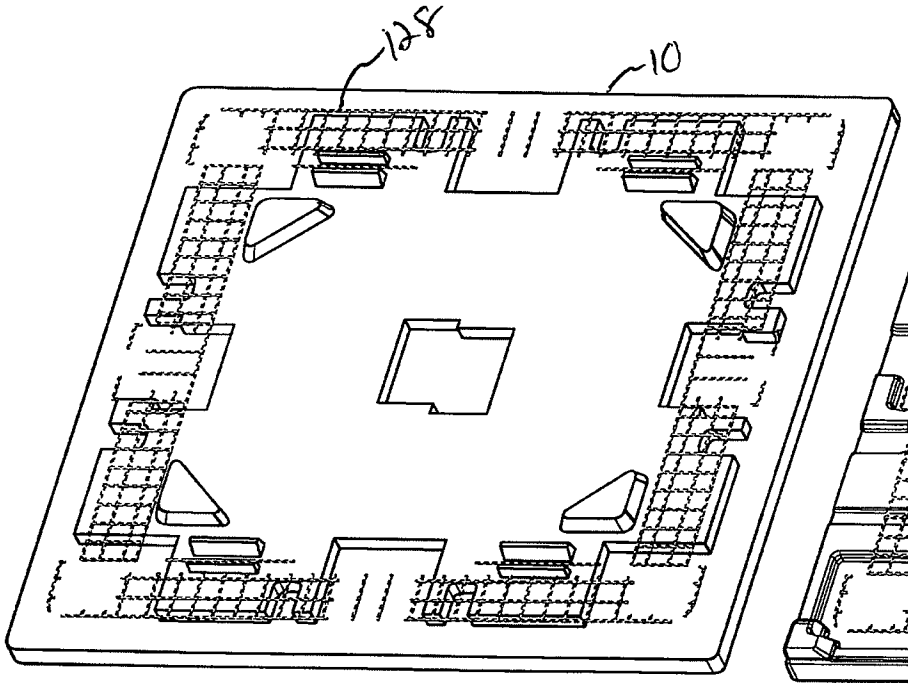
Figure 22B:
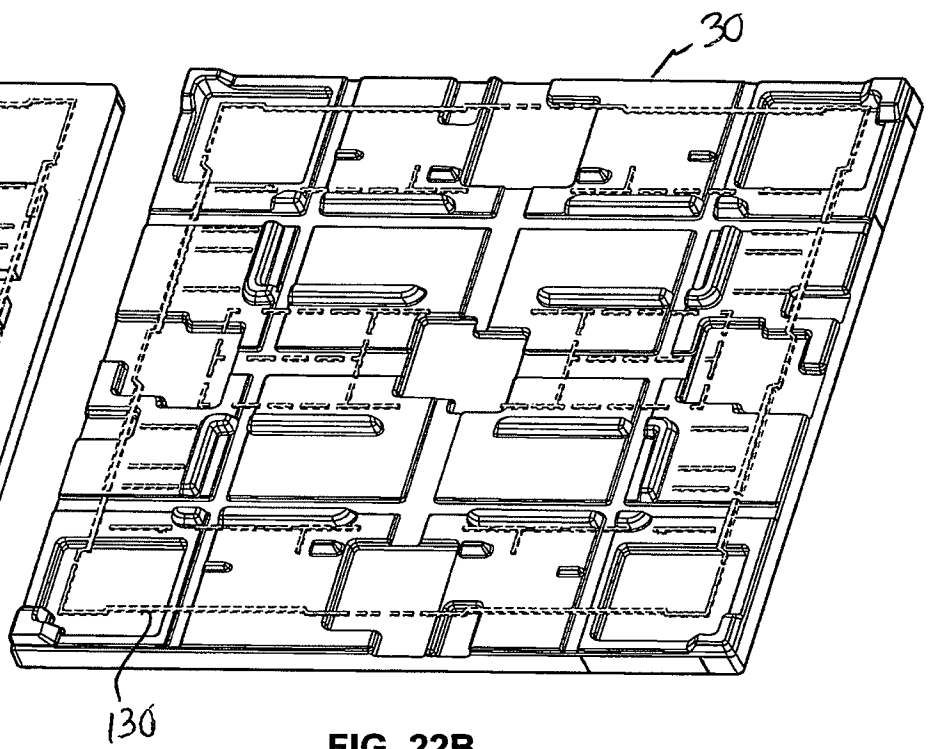
FIGS. 22A and 22B are a side by side view of the top caps of FIGS. 1 and 2 showing placement of the bottom surface or structure of the bulk bin of FIGS. 10A and 10B in phantom.
Figure 22A:
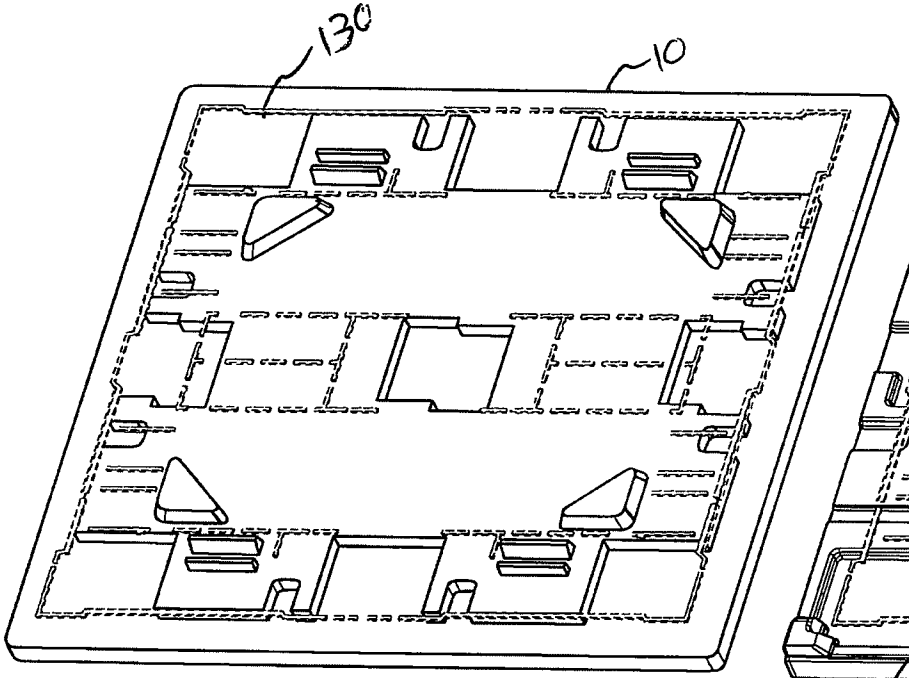
Figures 23A, 23B:
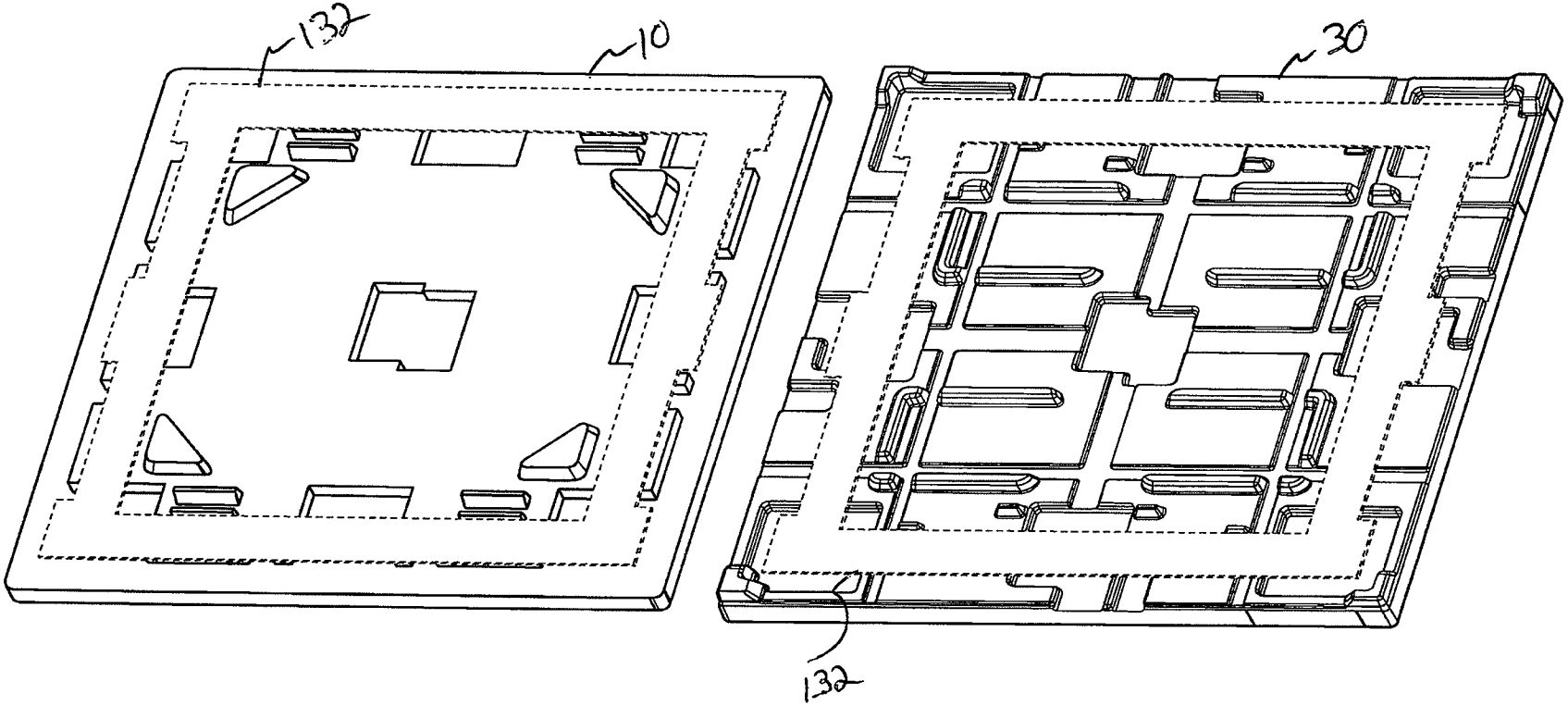
FIGS. 23A and 23B are a side by side view of the top caps of FIGS. 1 and 2 showing placement of the bottom surface or structure of the bulk bin of FIGS. 12A and 12B in phantom.
Figure 24B:
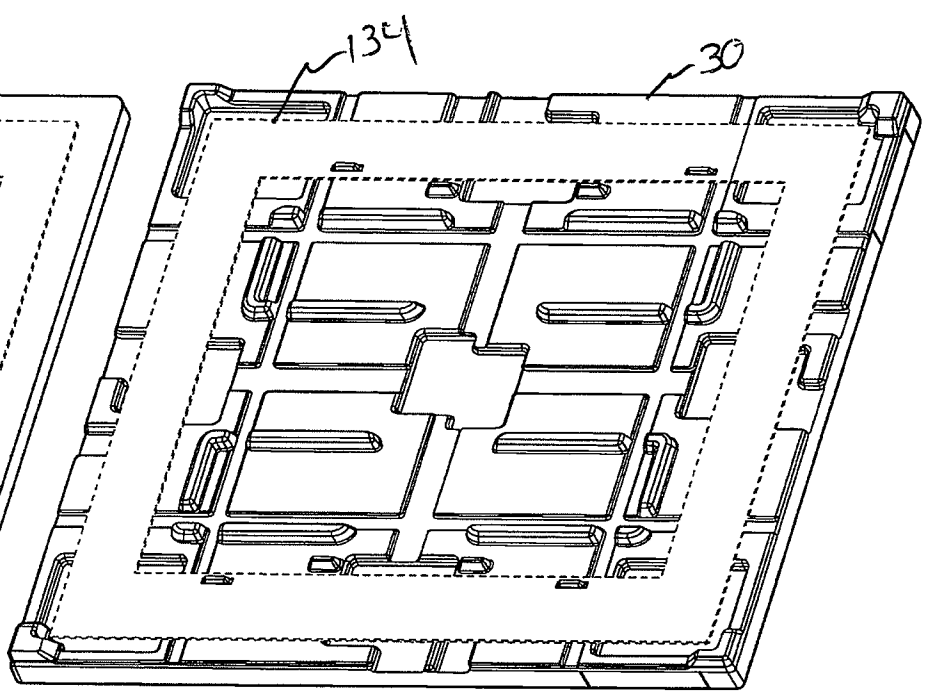
FIGS. 24A and 24B are a side by side view of the top caps of FIGS. 1 and 2 showing placement of the bottom surface or structure of the bulk bin of FIGS. 29A and 29B in phantom.
Figure 24A:
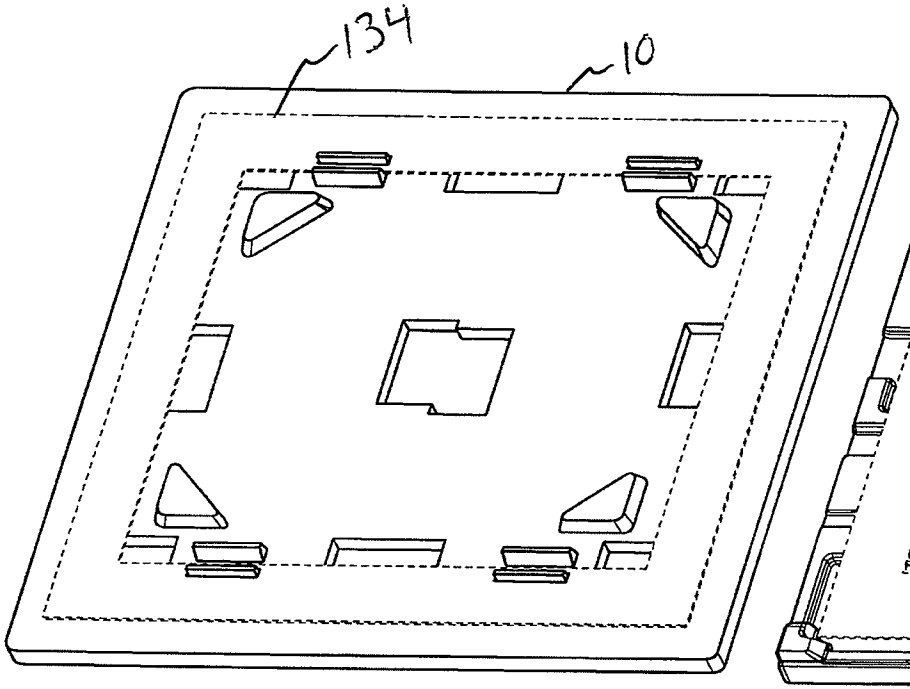
Figure 25B:
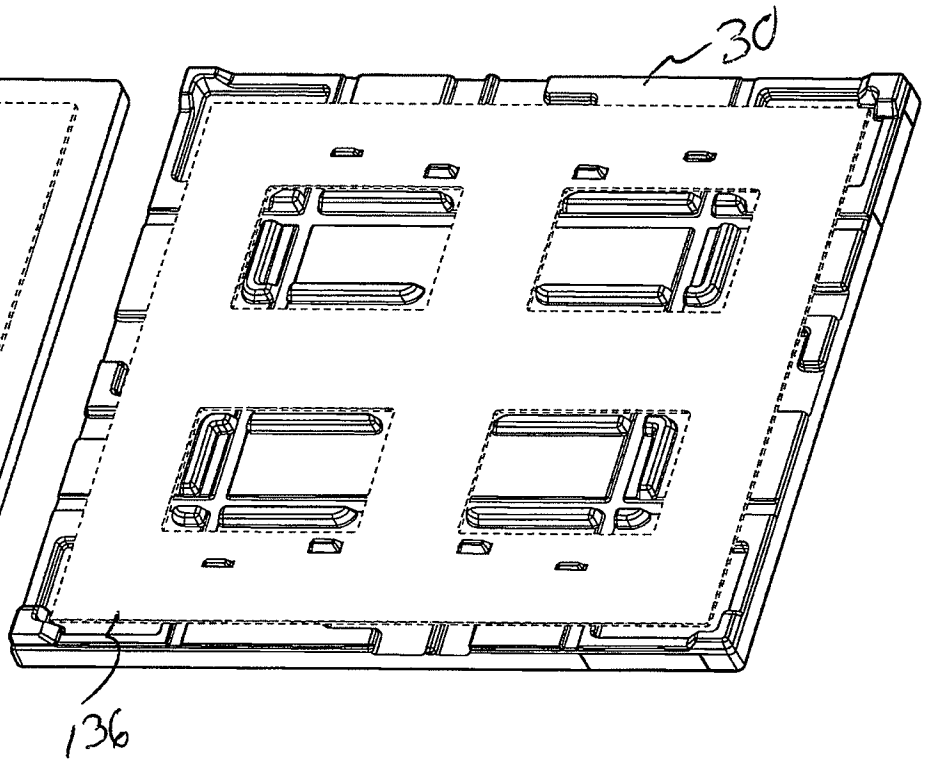
FIGS. 25A and 25B are a side by side view of the top caps of FIGS. 1 and 2 showing placement of the bottom surface or structure of the bulk bin of FIGS. 11A and 11B in phantom.
Figure 25A:
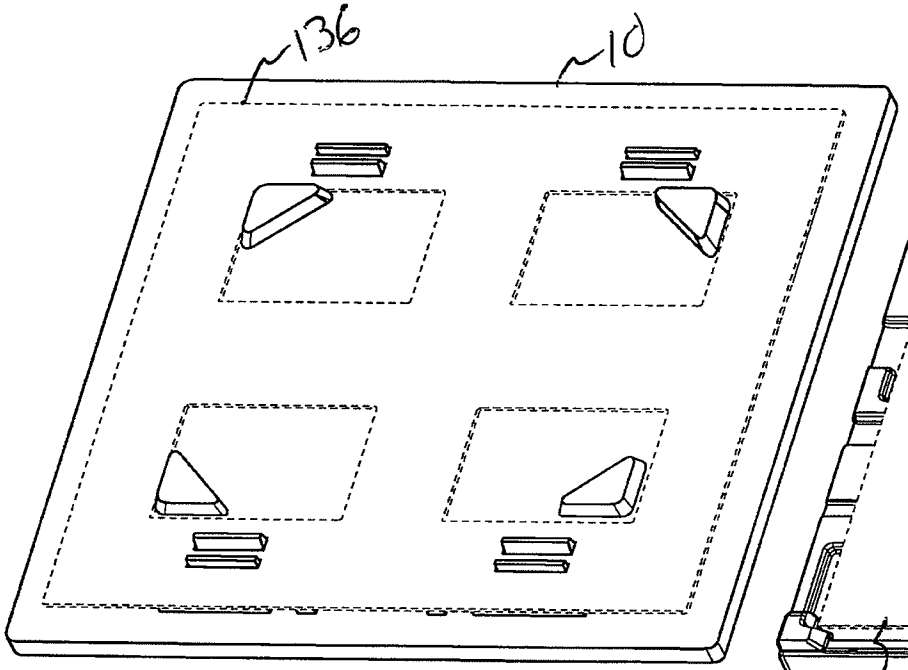

Similar to the pallet footprints, FIGS. 21A and 21B show the footprint 128 of the bottom surface or structure 86 of the ORBIS® HD45×48 Medium Duty bulk bin 88 shown in FIGS. 9A and 9B. FIGS. 22A and 22B show the footprint 130 of the bottom surface or structure 94 of the ORBIS® HD45×48 Heavy-Duty bulk bin 96 shown in FIGS. 10A and 10B. FIGS. 23A and 23B show the footprint 132 of the bottom surface or structure 104 of the Buckhorn 45×48 bulk bin 106 shown in FIGS. 12A and 12B. FIGS. 24A and 24B show the footprint 134 of the bottom surface or structure 150 of the ORBIS® KDR45×48 Medium Duty bulk bin 152 shown in FIGS. 29A and 29B. FIGS. 25A and 25B show the footprint 136 of the bottom surface or structure 100 of the ORBIS® HDR45×48 Heavy Duty bulk bin 102 shown in FIGS. 11A and 11B.

Figures 26A, 26B:
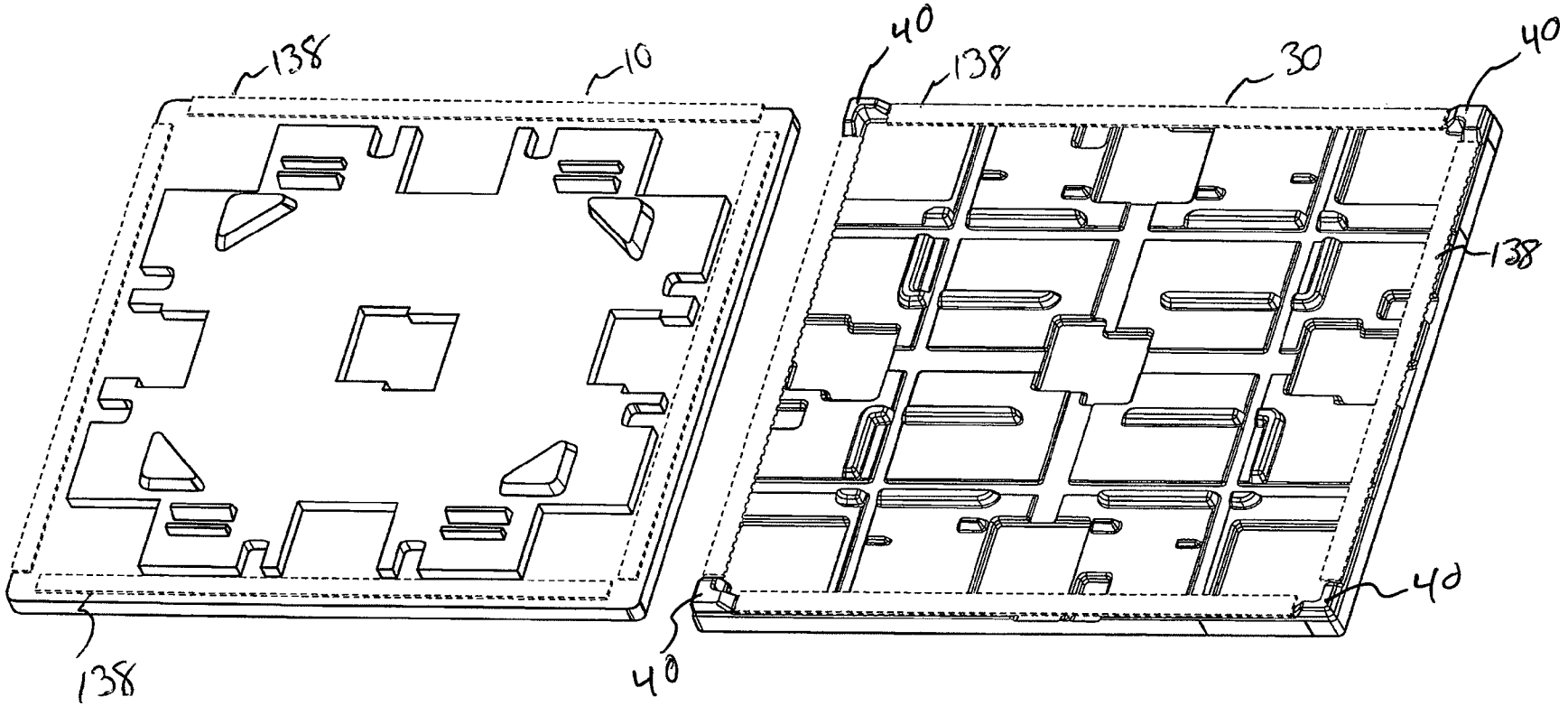
FIGS. 26A and 26B are a side by side view of the top caps of FIGS. 1 and 2 showing placement of the bottom surface or structure of the metal rack of FIGS. 13A and 13B in phantom.

Similar to the pallet and bulk bin footprints, FIGS. 26A and 26*b* show the footprint 138 of the bottom surface or structure 108 of the 45×48 Steel Rack 110 shown in FIGS. 13A and 13*b*. In particular, the corner projections 40 of the top cap 30 (FIG. 26B) are configured to coincide with the ends of the segments that make up the footprint 138, to properly align the Rack 110 on top of the top cap 30, and prevent movement of the Rack 110 during transportation.

Figure 27:
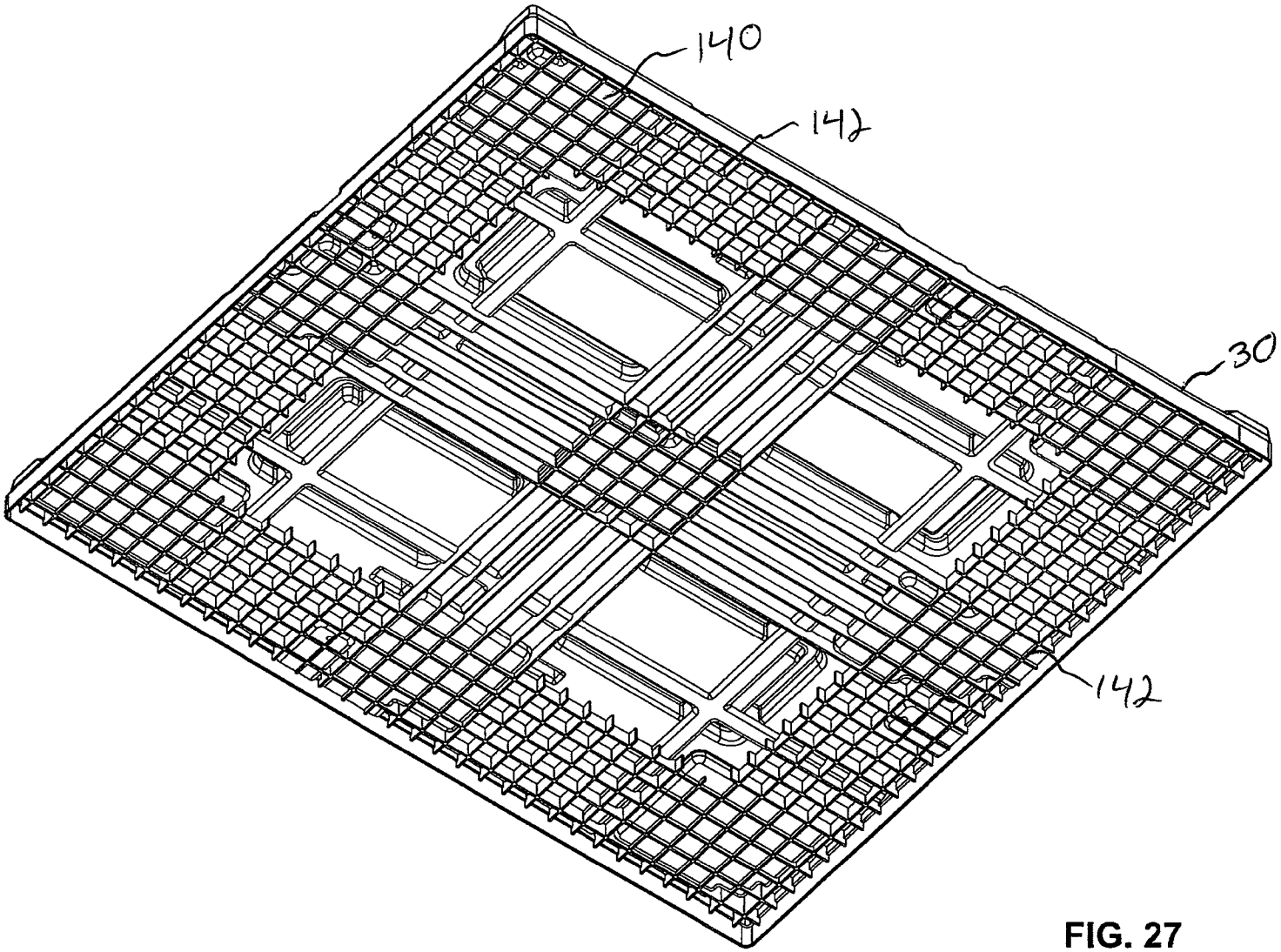
FIG. 27 is a perspective view of the bottom of the top cap of FIG. 2.

Referring to FIG. 27, a bottom view of the top cap 30 is provided. The bottom 140 of the top cap 30 includes a support plurality of ribs 142 extending downward from the bottom 140.

FIG. 28 provides another design for a top cap 144 made in accordance with the present invention. The top cap 144 is an intermediate design of the top cap 30.

While the specific embodiments have been illustrated and described, numerous modifications come to mind without significantly departing from the spirit of the invention, and the scope of protection is only limited by the scope of the accompanying Claims.

What is claimed is:

1. A top cap comprising:

a generally rectangular upper surface having a first side edge, a second side edge, a third side edge, and a fourth side edge, a first corner, a second corner, a third corner and a fourth corner;

a plurality of structures for supporting a pallet including a first square indentation in the upper surface sized to accommodate a first foot of the pallet proximate the first corner, a second square indentation in the upper surface sized to accommodate a second foot of the pallet proximate the second corner, a third square indentation in the upper surface sized to accommodate a third foot of the pallet proximate the third corner, and a fourth square indentation in the upper surface sized to accommodate a fourth foot of the pallet proximate the fourth corner;

a plurality of structures for supporting a bulk bin including a first raised ridge portion in the upper surface spaced from and parallel to the first side edge, a second raised ridge portion in the upper surface spaced from and parallel to the second side edge, a third raised ridge portion in the upper surface spaced from and parallel to the third side edge, and a fourth raised ridge portion in the upper surface spaced from and parallel to the fourth side edge; and, a plurality of structures for supporting a metal rack including a first raised corner portion in the upper surface having a first leg extending along the first side edge and a second leg extending along the fourth side edge, a second raised corner portion in the upper surface having a first leg extending along the first side edge and a second leg extending along the second side edge, a third raised corner portion in the upper surface having a first leg extending along the second side edge and a second leg extending along the third side edge, and a fourth raised corner portion in the upper surface having a first leg extending along the third side edge and a second leg extending along the fourth side edge.

2. The top cap of claim 1 wherein the plurality of structures for supporting a pallet further include a first middle indentation in the upper surface between the first square indentation and the second square indentation, a second middle indentation in the upper surface between the second square indentation and the third square indentation, a third middle indentation in the upper surface between the third square indentation and the fourth square indentation, and a fourth middle indentation between the fourth square indentation and the first square indentation.

3. The top cap of claim 2 wherein the plurality of structures for supporting a pallet further include a central indentation in the upper surface in a center portion of the top cap.

4. The top cap of claim 1 wherein the first raised ridge portion of the plurality of structures for supporting a hulk bin comprises a first raised ridge segment and second raised ridge segment spaced from and aligned with the first raised edge segment.

5. The top cap of claim 1 wherein the plurality of structures for supporting a bulk bin further comprises a fifth raised ridge portion spaced inward from and parallel to the first raised ridge portion, and a sixth raised ridge portion spaced inward from and parallel to the third raised ridge portion, wherein the fifth raised ridge portion is spaced from and parallel to the sixth raised ridge portion.

6. The top cap of claim 5 wherein the fifth raised ridge portion of the plurality of structures for supporting a bulk bin comprises a first raised ridge segment and second raised ridge segment spaced from and aligned with the first raised edge segment.

7. The top cap of claim 1 wherein the second raised ridge portion of the plurality of structures for supporting a bulk bin comprises a first raised ridge segment and second raised ridge segment spaced from and aligned with the first raised edge segment.

8. The top cap of claim 1 having a lower surface comprising a plurality of downwardly extending portions proximate the first, second, third and fourth side edges of the top cap.

9. The top cap of claim 1 wherein the top cap is formed from plastic.

10. A top cap comprising:

a generally rectangular upper surface having a first side edge, a second side edge, a third side edge, and a fourth side edge, a first corner, a second corner, a third corner and a fourth corner;

a plurality of flat regions for supporting feet of a pallet including a first rectangular flat corner region proximate the first corner, the first rectangular flat corner region defined by the first side edge, a first raised boundary portion spaced from the first side edge, the fourth side edge and a second raised boundary portion spaced from the fourth side edge and perpendicular to the first raised boundary portion, a second rectangular flat corner region proximate the second corner, the second rectangular flat corner region defined by the first side edge, a third raised boundary portion spaced from the first side edge, the second side edge, and a fourth raised boundary portion spaced from the second side edge and perpendicular to the third raised boundary portion, a third rectangular flat corner region proximate the third corner, the third rectangular flat corner region defined by the second side edge, a fifth raised boundary portion spaced from the second side edge, the third side edge and a sixth raised boundary portion spaced from the third side edge and perpendicular to the fifth raised boundary portion, and a fourth rectangular flat corner region proximate the fourth corner region, the fourth rectangular corner region defined by the third side edge, a seventh raised boundary portion spaced from the third side edge, the fourth side edge and an eighth raised boundary portion spaced from the fourth side edge and perpendicular to the seventh raised boundary portion;

a plurality of raised structures for supporting a bulk bin container including a first raised ridge portion in the upper surface spaced from and parallel to the first side edge, a second raised ridge portion in the upper surface spaced from and parallel to the second side edge, a third raised ridge portion in the upper surface spaced from and parallel to the third side edge, and a fourth raised ridge portion in the upper surface spaced from and parallel to the fourth side edge; and a plurality of flat segments for supporting a metal rack including a first flat strip adjacent the first side edge having a first raised border portion spaced from the first side edge, a second flat strip adjacent the second side edge having a second raised border portion spaced from the second side edge, a third flat strip adjacent the third side edge having a third raised border portion spaced from the third side edge, and a fourth flat strip adjacent the fourth side edge having a fourth raised border portion spaced from the fourth side edge.

11. The top cap of claim 10 wherein the plurality of flat regions for supporting feet of a pallet further include a first middle flat region proximate the first side edge between the first rectangular flat corner region and the second rectangular flat corner region, a second middle flat region proximate the second side edge between the second rectangular flat corner region and the third rectangular flat corner region, a third middle flat region proximate the third side edge between the third rectangular flat corner region and the fourth rectangular flat corner region, and a fourth middle flat region proximate the fourth side edge between the fourth rectangular flat corner region and the first rectangular flat corner region.

12. The top cap of claim 11 wherein the plurality of flat regions for supporting feet of a pallet further include a central flat region proximate a center portion of the top cap, the central flat portion including raised border portions around the central flat portion.

13. The top cap of claim 10 wherein the first raised ridge portion of the plurality of raised structures for supporting a bulk bin container comprises a first raised ridge segment and a second raised ridge segment spaced from and aligned with the first raised ridge segment.

14. The top cap of claim 10 having a lower surface comprising a plurality of downwardly extending portions proximate the first, second, third and fourth side edges of the top cap.

15. The top cap of claim 10 wherein the top cap is formed from plastic.

* * * * *